US010267134B2

(12) United States Patent
Cannan et al.

(10) Patent No.: US 10,267,134 B2
(45) Date of Patent: Apr. 23, 2019

(54) METHODS AND SYSTEMS FOR DETERMINING SUBTERRANEAN FRACTURE CLOSURE

(71) Applicant: CARBO Ceramics Inc., Houston, TX (US)

(72) Inventors: Chad Cannan, Houston, TX (US); Lewis Bartel, Albuquerque, NM (US); Terry Palisch, Richardson, TX (US); David Aldridge, Albuquerque, NM (US); Todd Roper, Katy, TX (US); Steve Savoy, Austin, TX (US); Daniel R. Mitchell, Austin, TX (US)

(73) Assignees: CARBO CERAMICS INC., Houston, TX (US); SANDIA CORPORATION, Albuquerque, NM (US)

( * ) Notice: Subject to any disclaimer, the term of this patent is extended or adjusted under 35 U.S.C. 154(b) by 672 days.

(21) Appl. No.: 14/942,304

(22) Filed: Nov. 16, 2015

(65) Prior Publication Data

US 2016/0069174 A1 Mar. 10, 2016

Related U.S. Application Data

(63) Continuation-in-part of application No. 14/629,004, filed on Feb. 23, 2015, now abandoned, which is a continuation-in-part of application No. 14/593,447, filed on Jan. 9, 2015, application No. 14/942,304, which is a continuation-in-part of application No. 14/572,486, filed on Dec. 16, 2014, now Pat. No. 9,434,875, said application No. 14/593,447 is a continuation of application No. 14/147,372, filed on Jan. 3, 2014, now Pat. No. 8,931,553, and a continuation of application No. PCT/US2014/010228, filed on Jan. 3, 2014.

(Continued)

(51) Int. Cl.
*E21B 43/267* (2006.01)

(52) U.S. Cl.
CPC ..... *E21B 43/267* (2013.01)

(58) Field of Classification Search
CPC ..... E21B 43/267; E21B 49/006
See application file for complete search history.

(56) References Cited

U.S. PATENT DOCUMENTS 8,797,037 B2 * 8/2014 Brannon ..... G01V 3/22 324/353
10,005,953 B2 * 6/2018 Dahi Taleghani ..... C09K 8/805
(Continued)

*Primary Examiner* — Shane Bomar
(74) *Attorney, Agent, or Firm* — Patterson + Sheridan LLP

(57) ABSTRACT

Methods and systems for determining subterranean fracture closure are disclosed herein. The methods can include electrically energizing a casing of a wellbore that extends from a surface of the earth into a subterranean formation having a fracture that is at least partially filled with an electrically conductive proppant and measuring a first electric field response at the surface or in an adjacent wellbore at a first time interval to provide a first field measurement. The methods can also include measuring a second electric field response at the surface or in the adjacent wellbore at a second time interval to provide a second field measurement and determining an increase in closure pressure on the electrically conductive proppant from a difference between the first and second field measurements.

20 Claims, 10 Drawing Sheets

Related U.S. Application Data

(60) Provisional application No. 61/749,093, filed on Jan. 4, 2013.

(56) References Cited

U.S. PATENT DOCUMENTS

| | | | | |
|---|---|---|---|---|
| 2013/0043873 | A1* | 2/2013 | Brannon | G01V 3/22 324/355 |
| 2016/0069174 | A1* | 3/2016 | Cannan | E21B 43/267 166/250.1 |
| 2016/0281498 | A1* | 9/2016 | Nguyen | E21B 43/267 |
| 2018/0252102 | A1* | 9/2018 | Anschutz | E21B 49/081 |

* cited by examiner

METHODS AND SYSTEMS FOR DETERMINING SUBTERRANEAN FRACTURE CLOSURE

CROSS-REFERENCE TO RELATED PATENT APPLICATIONS

This application is a continuation-in-part of U.S. patent application Ser. No. 14/572,486 filed on Dec. 16, 2014 which is incorporated herein by reference in its entirety. This application is also a continuation-in-part of U.S. patent application Ser. No. 14/629,004 filed on Feb. 23, 2015, which is a continuation-in-part of U.S. patent application Ser. No. 14/593,447 filed on Jan. 9, 2015, which is a continuation of U.S. patent application Ser. No. 14/147,372, now U.S. Pat. No. 8,931,553, filed on Jan. 3, 2014 and International Patent Application No. PCT/US2014/010228 filed Jan. 3, 2014, each of these prior applications being incorporated herein by reference in its entirety. U.S. patent application Ser. No. 14/629,004, U.S. patent application Ser. No. 14/593,447, U.S. patent application Ser. No. 14/147,372, and International Patent Application No. PCT/US2014/010228 each claims the benefit of U.S. Provisional Patent Application 61/749,093 filed Jan. 4, 2013 which is incorporated herein by reference in its entirety.

FIELD

Embodiments of the present invention relate generally to hydraulic fracturing of geological formations, and more particularly to electrically conductive proppants used in the hydraulic fracture stimulation of gas, oil, or geothermal reservoirs. Embodiments of the present invention relate to methods and systems utilizing the electrically conductive proppants.

BACKGROUND

In order to stimulate and more effectively produce hydrocarbons from downhole formations, especially formations with low porosity and/or low permeability, induced fracturing (called "frac operations", "hydraulic fracturing", or simply "fracing") of the hydrocarbon-bearing formations has been a commonly used technique. In a typical frac operation, fluids are pumped downhole under high pressure, causing the formations to fracture around the borehole, creating high permeability conduits that promote the flow of the hydrocarbons into the borehole. These frac operations can be conducted in horizontal and deviated, as well as vertical, boreholes, and in either intervals of uncased wells, or in cased wells through perforations.

In cased boreholes in vertical wells, for example, the high pressure fluids exit the borehole via perforations through the casing and surrounding cement, and cause the formations to fracture, usually in thin, generally vertical sheet-like fractures in the deeper formations in which oil and gas are commonly found. These induced fractures generally extend laterally a considerable distance out from the wellbore into the surrounding formations, and extend vertically until the fracture reaches a formation that is not easily fractured above and/or below the desired frac interval. Normally, if the fluid, sometimes called slurry, pumped downhole does not contain solids that remain lodged in the fracture when the fluid pressure is relaxed, then the fracture re-closes, and most of the permeability conduit gain is lost. These solids, called proppants, are generally composed of sand grains or ceramic particles that are placed in the induced fractures to keep them from fully re-closing. After the slurry is pumped downhole and the fluid pressure is released, the formation walls close on the propping agent creating a "propped fracture" which oftentimes provides a high conductivity channel in the subterranean formation. The time for fractures to close is formation dependent and is so far unable to be directly measured.

Although induced fracturing has been a highly effective tool in the production of hydrocarbon reservoirs, the amount of stimulation provided by this process depends to a large extent upon the ability to generate new fractures, or to create or extend existing fractures, as well as the ability to maintain open fractures through appropriate selection and placement of proppant. Reliable methods for detecting the closure time of fractures to confirming whether or not proppant selection and placement has been appropriate, are not available.

There is a need, therefore, for a method of detecting when and where a fracture closes to determine fracture closure time and the extent of fracture closure.

BRIEF DESCRIPTION OF THE DRAWINGS

The invention may best be understood by referring to the following description and accompanying drawings that are used to illustrate embodiments of the invention. In the drawings.

DETAILED DESCRIPTION

In the following description, numerous specific details are set forth. However, it is understood that embodiments of the invention may be practiced without these specific details. In other instances, well-known structures and techniques have not been shown in detail in order not to obscure the understanding of this description.

Described herein are methods for determining fracture closure. In particular, disclosed herein are methods for determining a closure time of a fracture by electrically energizing a proppant pack of electrically conductive sintered, substantially round and spherical particles in the fracture. Also disclosed herein are electromagnetic methods that include electrically energizing the earth at or near a fracture at depth and measuring the electric and magnetic responses at the earth's surface or in adjacent wells/boreholes at a series of time intervals.

The electrically conductive sintered, substantially round and spherical particles, referred to hereinafter as "electrically conductive proppant," can be detectable by electromagnetic (EM) methods. The electrically conductive proppant can include one or more coatings of electrically conductive material on its outer surfaces. The term "substantially round and spherical" and related forms, as used herein, is defined to mean an average ratio of minimum diameter to maximum diameter of about 0.8 or greater, or having an average sphericity value of about 0.8 or greater compared to a Krumbein and Sloss chart.

Figure 1:
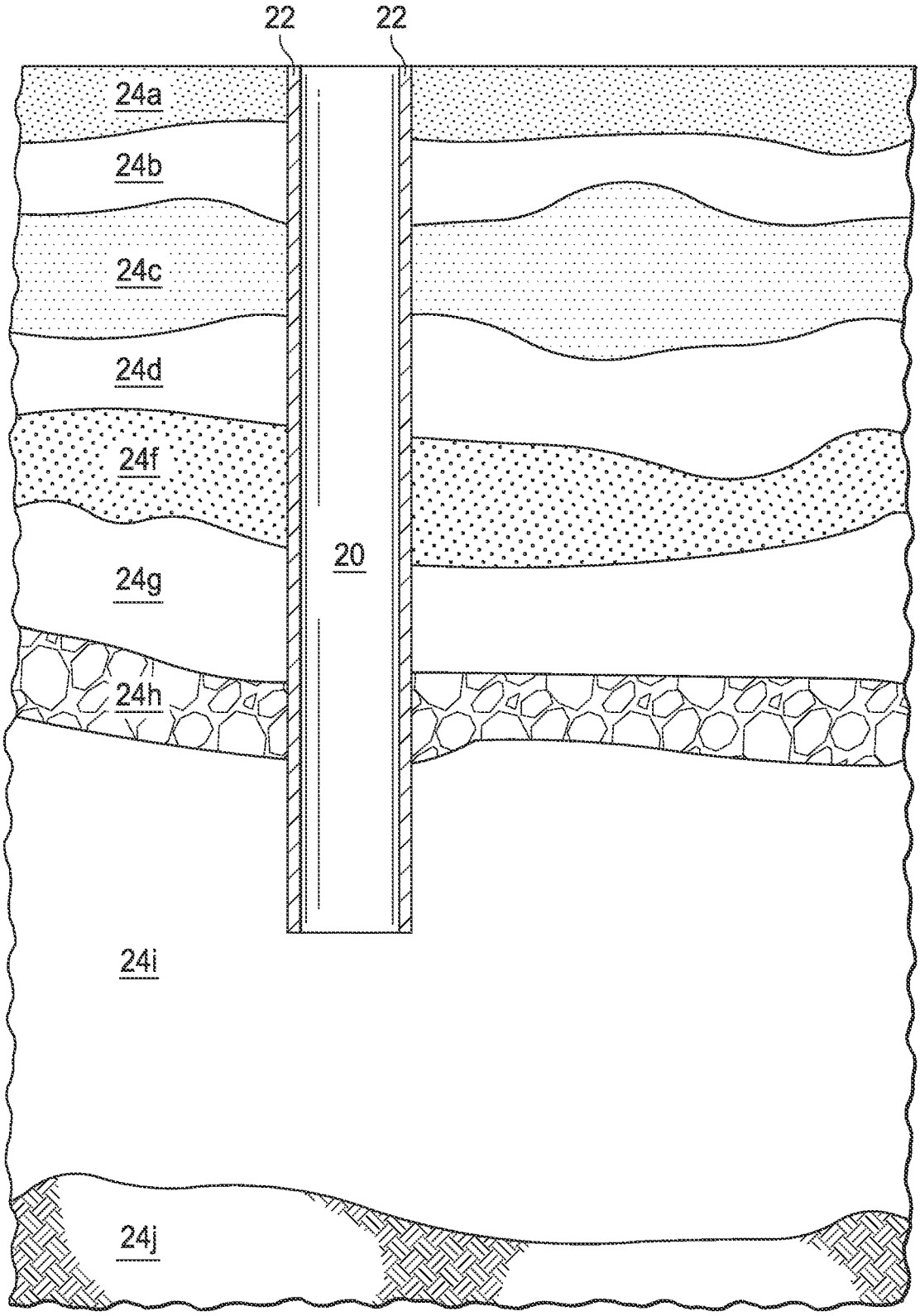
FIG. 1 is a diagram of the geometric layout of a vertical or deviated well in which layers of the earth having varying electrical and mechanical properties are depicted.

The electromagnetic methods described herein can include energizing the earth in the fractured well/borehole or in a well/borehole adjacent to the fractured well/borehole. The electromagnetic methods described herein can be used in connection with a cased wellbore, such as well 20 shown in FIG. 1, or in an uncased wellbore (not shown). As shown in FIG. 1, casing 22 extends within well 20 and well 20 extends through geological strata 24*a*-24*i* in a manner that has three dimensional components.

Figure 2:
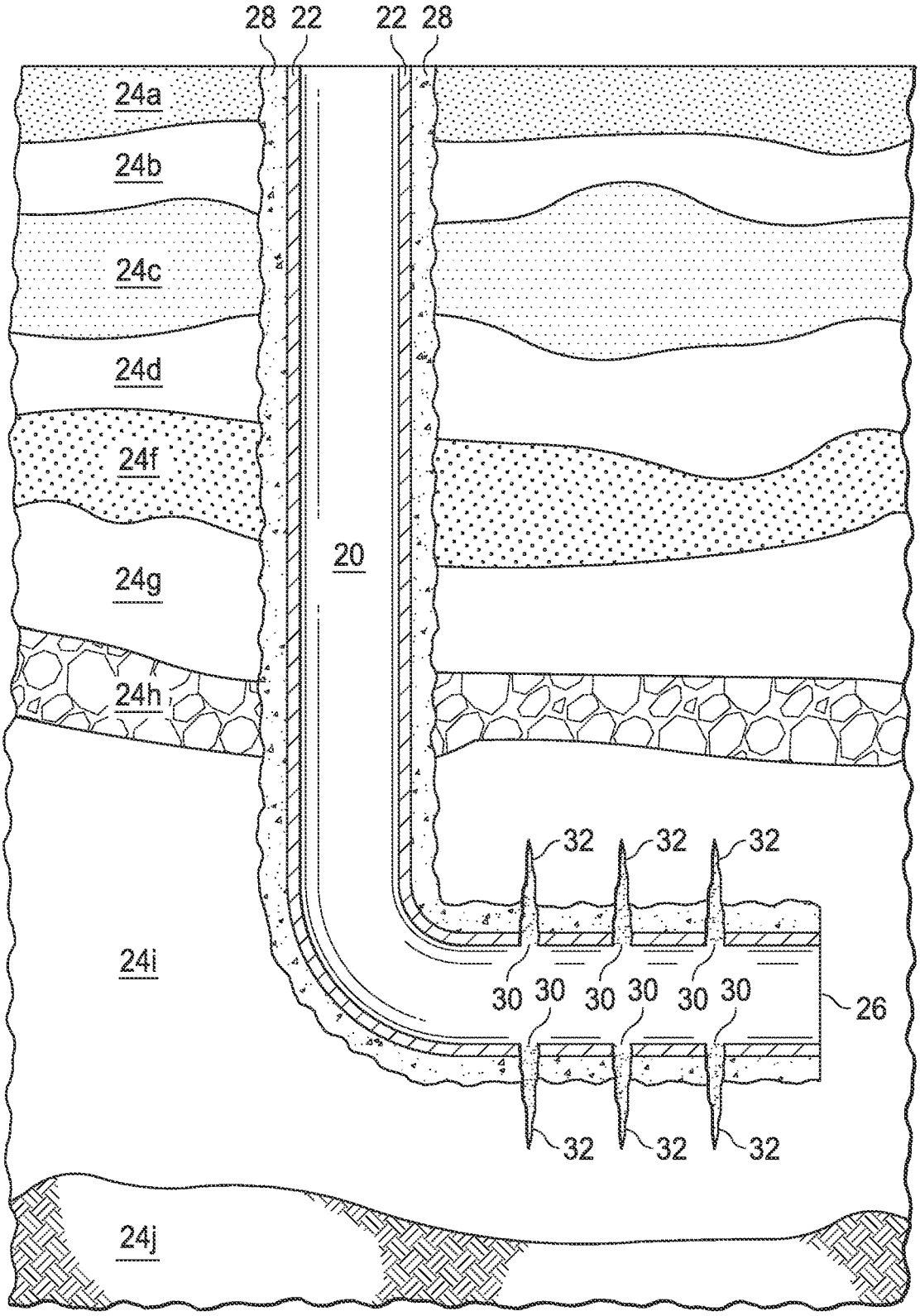
FIG. 2 is a schematic of an installed horizontal wellbore casing string traversing a hydrocarbon bearing zone with proppant filled fractures in which layers of the earth having varying electrical and mechanical properties are depicted.

Referring now to FIG. 2, a partial cutaway view is shown with production well 20 extending vertically downward through one or more geological layers 24*a*-24*i* and horizontally in layer 24*i*. While wells are conventionally vertical, the electromagnetic methods described herein are not limited to use with vertical wells. Thus, the terms "vertical" and "horizontal" are used in a general sense in their reference to wells of various orientations.

The preparation of production well 20 for hydraulic fracturing can include drilling a bore 26 to a desired depth and then in some cases extending the bore 26 horizontally so that the bore 26 has any desired degree of vertical and horizontal components. A casing 22 can be cemented 28 into well 20 to seal the bore 26 from the geological layers 24*a*-24*i* in FIG. 2. The casing 22 can have a plurality of perforations 30 and/or sliding sleeves (not shown). The perforations 30 are shown in FIG. 2 as being located in a horizontal portion of well 20 but those of ordinary skill in the art will recognize that the perforations can be located at any desired depth or horizontal distance along the bore 26, but are typically at the location of a hydrocarbon bearing zone in the geological layers 24, which may be within one or more of the geological layers 24*a*-24*j*. Those of ordinary skill in the art will also recognize that the well 20 can include no casing, such as in the case of an open-hole well. The hydrocarbon bearing zone may contain oil and/or gas, as well as other fluids and materials that have fluid-like properties. The hydrocarbon bearing zone in geological layers 24*a*-24*j* is hydraulically fractured by pumping a fluid into casing 22 and through perforations 30 at sufficient rates and pressures to create fractures 32 and then incorporating into the fluid an electrically conductive proppant which will prop open the created fractures 32 when the hydraulic pressure used to create the fractures 32 is released.

The hydraulic fractures 32 shown in FIG. 2 are oriented radially away from the metallic well casing 22. This orientation is exemplary in nature. In practice, hydraulically-induced fractures 32 may be oriented radially as in FIG. 2, laterally or intermediate between the two. Various orientations are exemplary and not intended to restrict or limit the electromagnetic methods described herein in any way.

The electrically conductive proppant can be introduced into one or more subterranean fractures during any suitable hydraulic fracturing operation to provide an electrically conductive proppant pack. In one or more exemplary hydraulic fracturing operations, any combination of the electrically conductive proppant and a non-electrically conductive proppant can be introduced into one or more fractures to provide an electrically conductive proppant pack. The electrically conductive proppant of the electrically conductive proppant pack can include a non-uniform coating of electrically conductive material and/or a substantially uniform coating of electrically conductive material.

According to certain embodiments of the electromagnetic method of the present invention and as shown schematically in FIG. 3, electric current is carried down wellbore 20 to an energizing point which will generally be located within 10 meters or more (above or below) of perforations 30 in casing 22 via a seven strand wire line insulated cable 34, such as those which are well known to those of ordinary skill in the art and are widely commercially available from Camesa Wire, Rochester Wire and Cable, Inc., WireLine Works, Novametal Group, and Quality Wireline & Cable Inc. In other exemplary embodiments, the wire line insulated cable 34 can contain 1 to 6 strands or 8 or more strands. A sinker bar 36 connected to the wire line cable 34 contacts or is in close proximity to the well casing 22 whereupon the well casing 22 becomes a current line source that produces subsurface electric and magnetic fields. In other exemplary embodiments, the wire line cable 34 can be connected to or otherwise attached to a centralizer and/or any other suitable downhole tool in addition to or in lieu of the sinker bar 26. These fields interact with the fracture 32 containing electrically conductive proppant to produce secondary electric and magnetic fields that can be used to detect closure and closure time of the proppant-filled fracture 32.

Figure 3:
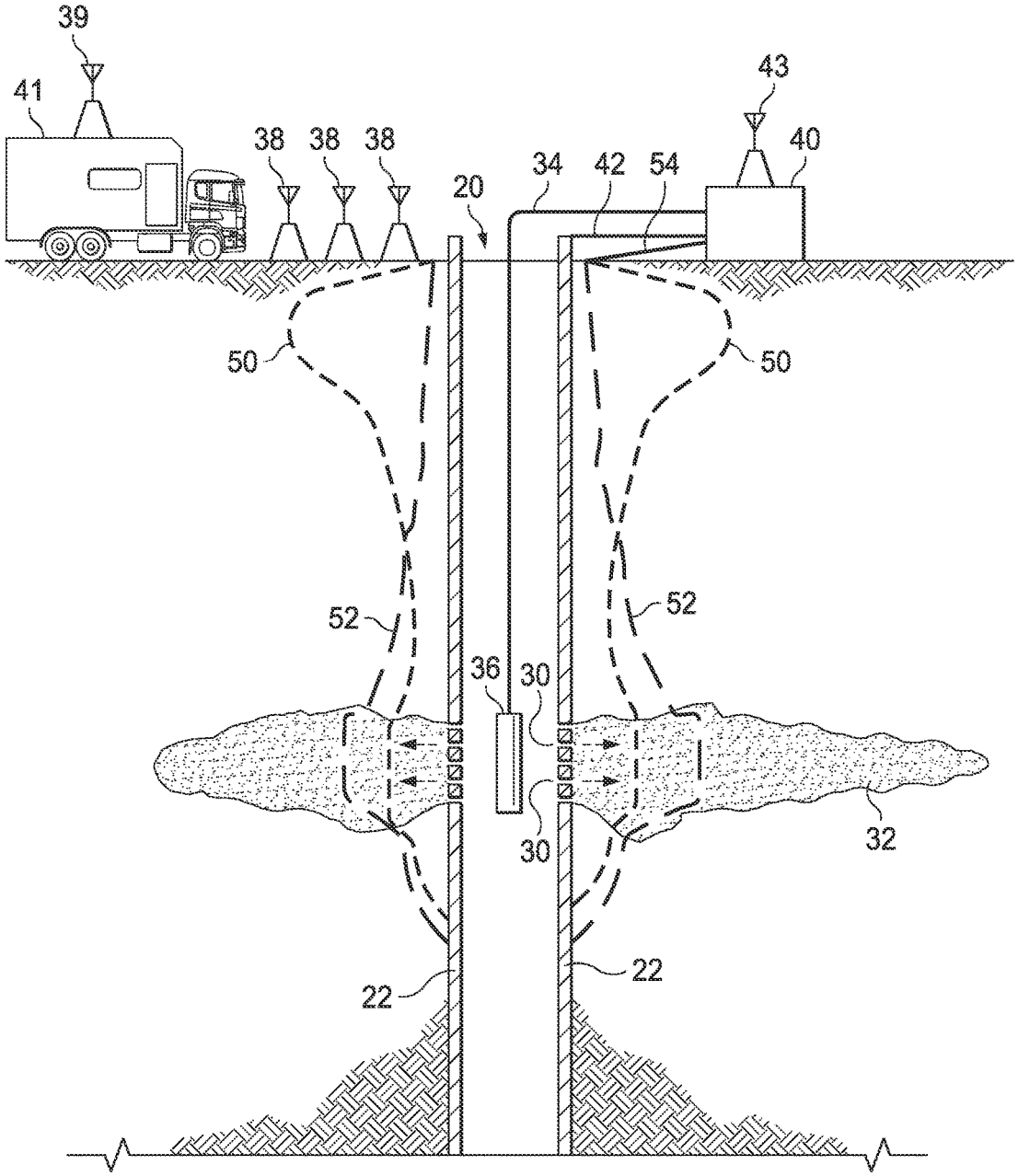
FIG. 3 is a schematic cross-sectional illustration off a hydraulic fracture mapping system which depicts two embodiments for introducing electric current into a wellbore, namely energizing the wellbore at the surface or energizing via a wireline with a sinker bar near the perforations in the wellbore.

According to certain embodiments of the electromagnetic method of the present invention and as shown schematically in FIG. 3, a power control box 40 is connected to casing 22 by a cable 42 to provide an electric current return for current injected via the sinker bar 36. Another embodiment is to connect the power control box 40 directly to the earth via cable 54. Another embodiment is to inject a current into the fracture well 20 by directly energizing the casing 22 at the well head or any other suitable surface location with the current return cable 54 connected to the earth. In one embodiment, the power control box 40 is connected wirelessly by a receiver/transmitter 43 to a receiver/transmitter 39 on equipment truck 41. Those of ordinary skill in the art will recognize that other suitable means of carrying the current to the energizing point may also be employed.

The electric current source may be configured to generate input current waveforms of various types (i.e., pulses, continuous wave, or repeating or periodic waveforms or pseudo random binary pulse) that generate input electromagnetic field waveforms having a corresponding amplitude and corresponding temporal characteristics to the input current waveform. Accordingly, the conductive casing can be electrically energized and act as a spatially-extended source of electric current.

Some of the electric current generated by the source can travel from the well casing 22 through the proppant of the induced fracture 32 of the geologic formation. Electromagnetic fields generated by the current in the well casing 22 and that propagate to various locations in a volume of Earth can be altered by the presence of the proppant following the injection of the proppant into the fracture 32. Electromagnetic fields generated by the currents in both the well casing and the proppant propagate to various locations in a three-dimensional volume of Earth and are sensed using sensors.

Figure 4:
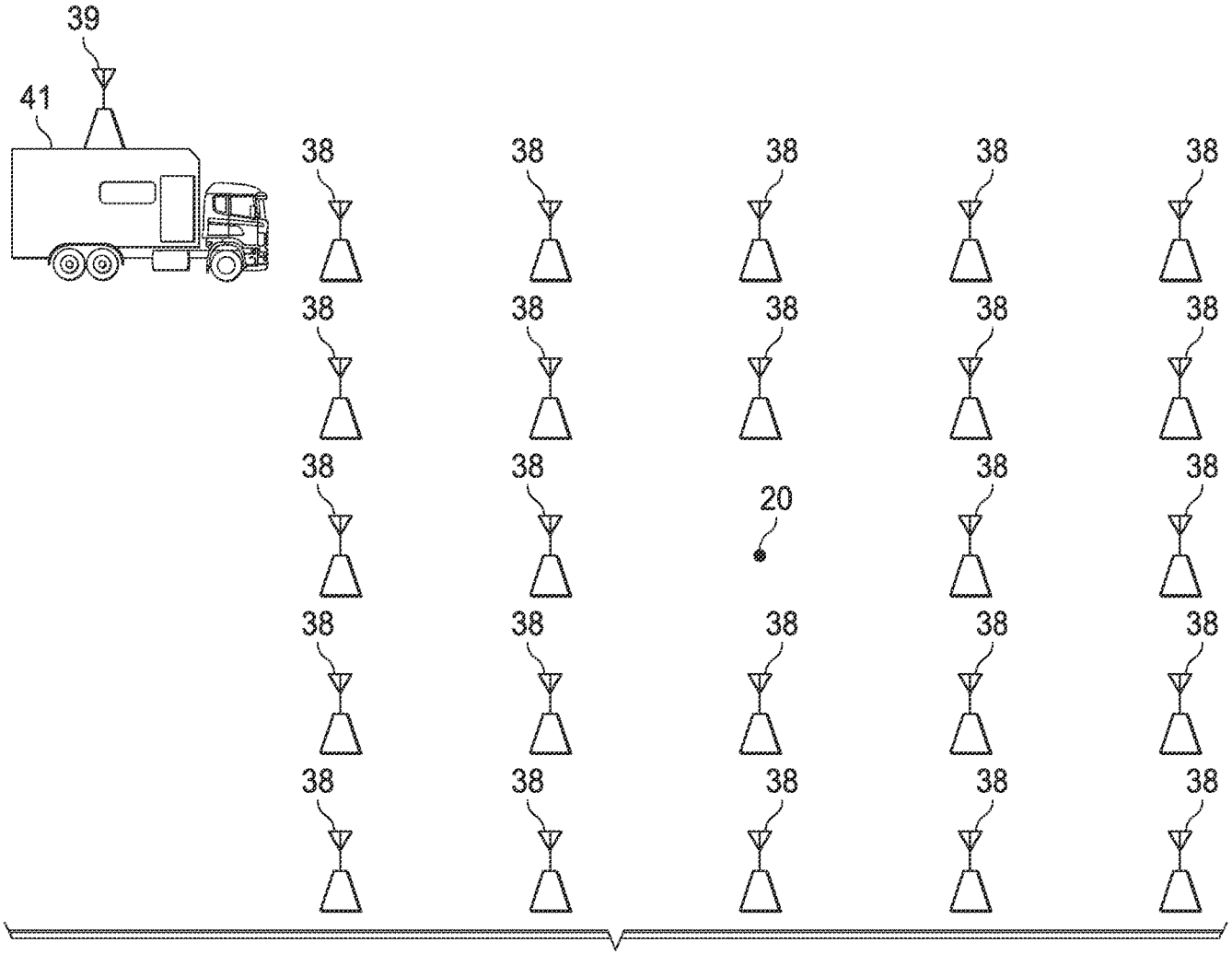
FIG. 4 is a schematic plan illustration of a hydraulic fracture mapping system.
Figure 5:
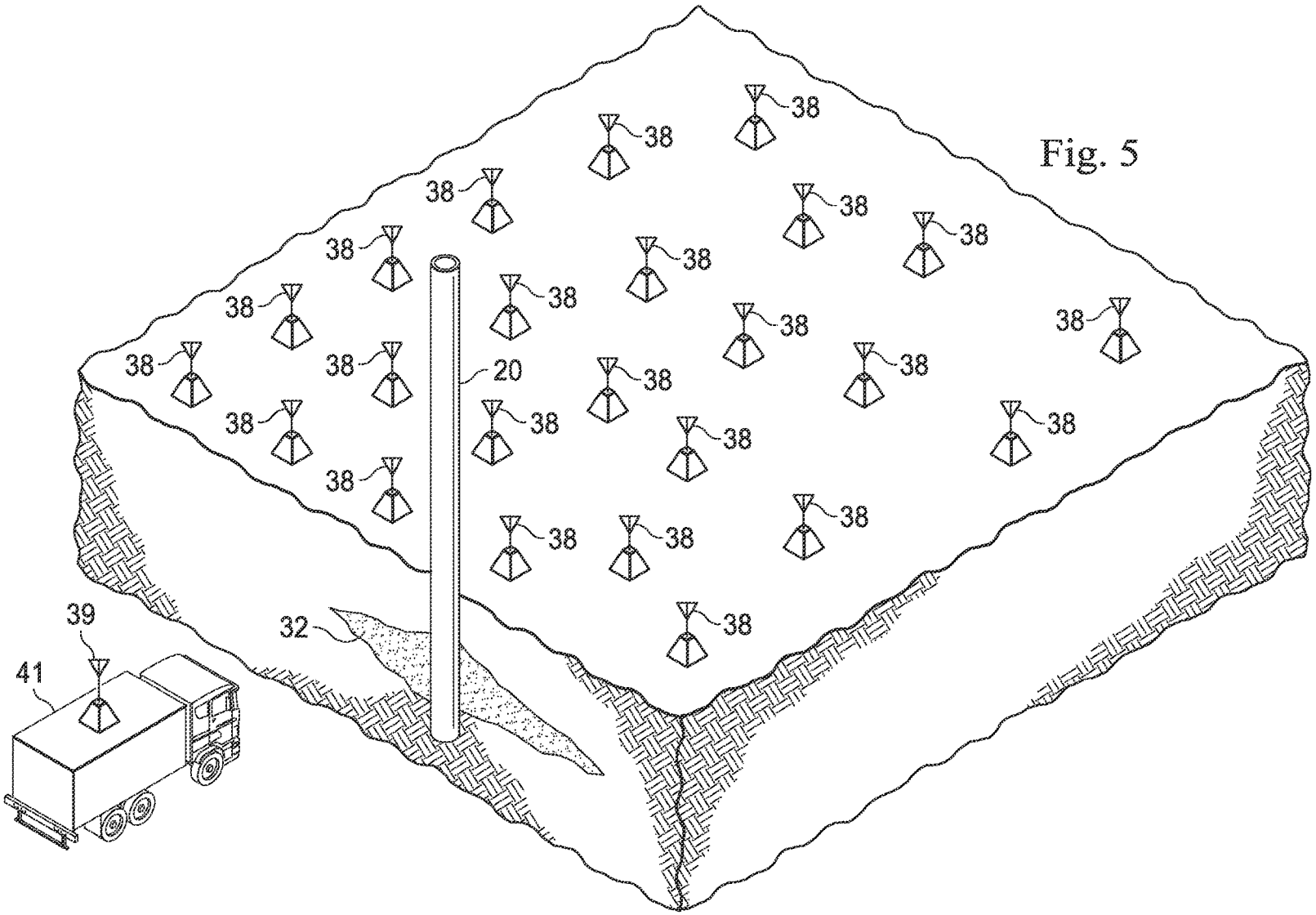
FIG. 5 is a schematic perspective illustration of a hydraulic fracture mapping system.

As shown schematically in FIGS. 3-5, a plurality of electric and magnetic field sensors 38 will be located on the earth's surface in a rectangular or other suitable array covering the area around the fracture well 20 and above the anticipated fracture 32. In one embodiment, the sensors 38 are connected wirelessly to a receiver/transmitter 39 on equipment truck 41. The maximum dimension of the array (aperture) in general should be at least 80 percent of the depth to the fracture zone. Sensor locations can be optimized for detecting the proppant filled fracture 32 using numerical simulations. The sensors 38 will measure the x, y and z component responses of the electric and magnetic fields. It is these responses that will be used to infer closure and closure time of the electrically conductive proppant filled fracture through comparison to numerical simulations and/or inversion of the measured data to determine the source of the responses. The responses of the electric and magnetic field components will depend upon: the orientation of the fracture well 20, the orientation of the fracture 32, the electrical conductivity, magnetic permeability, and electric permittivity of layers 24*a*-24*j*, the electrical conductivity, magnetic permeability, and electric permittivity of the proppant filled fracture 32, and the volume of the proppant filled fracture 32. Moreover, the electrical conductivity, magnetic permeability and electric permittivity of the geological layers residing between the surface and the target formation layers 24*a*-24*j* influence the recorded responses. From the field-recorded responses, details of the proppant filled fracture 32, such as location and closure, can be determined.

In another embodiment, electric and magnetic sensors may be located in adjacent well/boreholes.

Figure 6A:
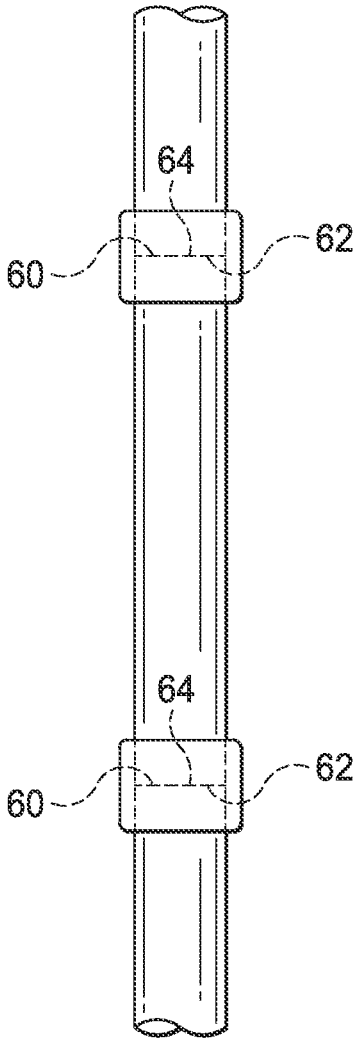
FIG. 6A is a schematic illustration of an electrically insulated casing joint.
Figure 6B:
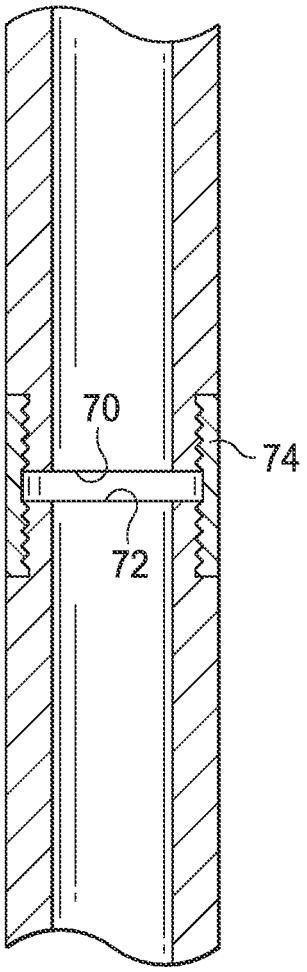
FIG. 6B is a schematic illustration of an electrically insulated casing collar.

Depending upon the conductivity of the earth surrounding the well casing 22, the current may or may not be uniform as the current flows back to the surface along the well casing 22. According to both embodiments shown in FIG. 3, current leakage occurs along wellbore 20 such as along path 50 or 52 and returns to the electrical ground 54 which is established at the well head. As described in U.S. patent application Ser. No. 13/206,041 filed Aug. 9, 2011 and entitled "Simulating Current Flow Through a Well Casing and an Induced Fracture," the entire disclosure of which is incorporated herein by reference, the well casing is represented as a leaky transmission line in data analysis and numerical modeling. Numerical simulations have shown that for a conducting earth (conductivity greater than approximately 0.05 Siemens per meter (S/m)), the current will leak out into the formation, while if the conductivity is less than approximately 0.05 S/m the current will be more-or-less uniform along the well casing 22. As shown in FIGS. 6A and 6B, to localize the current in the well casing 22, electrically insulating pipe joints or pipe collars may be installed. According to the embodiment shown in FIG. 6A, an insulating joint may be installed by coating the mating surfaces 60 and 62 of the joint with a material 64 having a high dielectric strength, such as any one of the well-known and commercially available plastic or resin materials which have a high dielectric strength and which are of a tough and flexible character adapted to adhere to the joint surfaces so as to remain in place between the joint surfaces. As described in U.S. Pat. No. 2,940,787, the entire disclosure of which is incorporated herein by reference, such plastic or resin materials include epoxies, phenolics, rubber compositions, and alkyds, and various combinations thereof. Additional materials include polyetherimide and modified polyphenylene oxide. According to the embodiment shown in FIG. 6B, the mating ends 70 and 72 of the joint are engaged with an electrically insulated casing collar 74. The transmission line representation is able to handle various well casing scenarios, such as vertical only, slant wells, vertical and horizontal sections of casing, and, single or multiple insulating gaps, as well as the cement used to stabilize the well casing.

The electrically conductive proppant pack can include a plurality of electrically conductive proppant particles, each of the plurality of electrically conductive proppant particles can have a substantially uniform coating of electrically conductive material. The substantially uniform coating of electrically conductive material can have any suitable thickness. In one or more exemplary embodiments, the substantially uniform coating of electrically conductive material can have a thickness of about 5 nm, about 10 nm, about 25 nm, about 50 nm, about 100 nm, or about 200 nm to about 300 nm, about 400 nm, about 500 nm, about 750 nm, about 1,000 about 1,500 nm, about 2,000 nm, or about 5,000 nm or more. For example, the thickness of the substantially uniform coating of electrically conductive material can be from about 10 nm to about 300 nm, from about 400 nm to about 1,000 nm, from about 200 nm to about 600 nm, or from about 100 nm to about 400 nm.

In one or more exemplary embodiments, the electrically conductive proppant can include an irregular or non-uniform coating of electrically conductive material. The non-uniform coating of electrically conductive material can cover or coat any suitable portion of the surface of a proppant particle. In one or more exemplary embodiments, the coating of electrically conductive material can cover at least about 10%, at least about 15%, at least about 20%, at least about 30%, at least about 40%, or at least about 50% of the surface of the electrically conductive proppant particle. In one or more exemplary embodiments, the coating of electrically conductive material can cover less than 100%, less than 99%, less than 95%, less than 90%, less than 85%, less than 80%, less than 75%, less than 65%, less than 50%, less than 40%, or less than 35% of the surface of the electrically conductive proppant particle. In one or more exemplary embodiments, about 25%, about 30%, about 35%, or about 45% to about 55%, about 65%, about 75%, about 85%, about 90%, about 95%, or about 99% or more of the surface of the electrically conductive proppant particle can be covered by the electrically conductive material. For example, the coating of electrically conductive material can cover from about 10% to about 99%, from about 15% to about 95%, from about 20% to about 75%, from about 25% to about 65%, from about 30% to about 45%, from about 35% to about 75%, from about 45% to about 90%, or from about 40% to about 95% of the surface of the electrically conductive proppant particle.

The non-uniform coating of electrically conductive material can have any suitable thickness. In one or more exemplary embodiments, the non-uniform coating of electrically conductive material can have an average thickness ranging from about 5 nm, about 10 nm, about 25 nm, about 50 nm, about 100 nm, or about 200 nm to about 300 nm, about 400 nm, about 500 nm, about 750 nm, about 1,000 about 1,500 nm, about 2,000 nm, or about 5,000 nm or more. For example, the average thickness of the non-uniform coating of electrically conductive material can be from about 400 nm to about 1,000 nm, from about 200 nm to about 600 nm, or from about 100 nm to about 400 nm. The non-uniform coating of electrically conductive material can also have any suitable variation in thickness. In one or more exemplary embodiments, the thickness of the non-uniform coating of electrically conductive material can vary from about 10 nm to about 1,000 nm, from about 50 nm to about 500 nm, from about 100 nm to about 400 nm, or from about 400 nm to about 1,000 nm.

The electrically conductive proppant pack can have any suitable electrical conductivity. In one or more exemplary embodiments, the electrically conductive proppant pack can have an electrical conductivity of at least about 1 Siemen per meter (S/m), at least about 5 S/m, at least about 15 S/m, at least about 50 S/m, at least about 100 S/m, at least about 250 S/m, at least about 500 S/m, at least about 750 S/m, at least about 1,000 S/m, at least about 1,500 S/m, or at least about 2,000 S/m. The electrical conductivity of the pack can also be from about 10 S/m, about 50 S/m, about 100 S/m, about 500 S/m, about 1,000 S/m, or about 1,500 S/m to about 2,000 S/m, about 3,000 S/m, about 4,000 S/m, about 5,000 S/m, or about 6,000 S/m. The electrically conductive proppant pack can have any suitable resistivity. In one or more exemplary embodiments, the pack can have a resistivity of less than 100 Ohm-cm, less than 80 Ohm-cm, less than 50 Ohm-cm, less than 25 Ohm-cm, less than 15 Ohm-cm, less than 5 Ohm-cm, less than 2 Ohm-cm, less than 1 Ohm-cm, less than 0.5 Ohm-cm, or less than 0.1 Ohm-cm.

The electrically conductive proppant pack can also include non-electrically conductive proppant in any suitable amounts. The non-electrically conductive proppant can have any suitable resistivity. For example, the non-electrically conductive proppant can have a resistivity of at least about $1\times10^5$ Ohm-cm, at least about $1\times10^8$ Ohm-cm, at least about $1\times10^{10}$ Ohm-cm, at least about $1\times10^{11}$ Ohm-cm, or at least about $1\times10^{12}$ Ohm-cm. The electrically conductive proppant pack can include any suitable amount of non-electrically conductive proppant. In one or more exemplary embodiments, the electrically conductive proppant pack can include at least about 1 wt %, at least about 5 wt %, at least about 10 wt %, at least about 20 wt %, at least about 40 wt %, at least about 50 wt %, at least about 60 wt %, at least about 70 wt %, at least about 80 wt %, at least about 90 wt %, or at least about 95 wt % non-electrically conductive proppant. In one or more exemplary embodiments, the electrically conductive proppant pack can include at least about 1 wt %, at least about 5 wt %, at least about 10 wt %, at least about 20 wt %, at least about 40 wt %, at least about 50 wt %, at least about 60 wt %, at least about 70 wt %, at least about 80 wt %, at least about 90 wt %, or at least about 95 wt % electrically conductive proppant. In one or more exemplary embodiments, the electrically conductive proppant pack can have an electrically conductive proppant concentration of about 2 wt %, about 4 wt %, about 8 wt %, about 12 wt %, about 25 wt %, about 35 wt %, or about 45 wt % to about 55 wt %, about 65 wt %, about 75 wt %, about 85 wt %, or about 95 wt % based on the total weight of the proppant pack. In one or more exemplary embodiments, the electrically conductive proppant pack can include from about 1 wt % to about 10 wt %, from about 10 wt % to about 25 wt %, about 25 wt % to about 50 wt %, from about 50 wt % to about 75 wt %, or from about 75 wt % to about 99 wt % non-electrically conductive proppant. The non-electrically conductive proppant can be dispersed throughout the electrically conductive proppant pack in any suitable manner. For example, the non-electrically conductive proppant can be substantially evenly dispersed throughout the electrically conductive proppant pack.

The electrically conductive proppant pack containing the non-conductive proppant can have any suitable resistivity. In one or more exemplary embodiments, the electrically conductive proppant pack containing at least about 20 wt %, at least about 40 wt %, at least about 50 wt %, or at least about 60 wt % non-conductive proppant can have a resistivity of less than 1,000 Ohm-cm, less than 500 Ohm-cm, less than 200 Ohm-cm, less than 100 Ohm-cm, less than 80 Ohm-cm, less than 50 Ohm-cm, less than 25 Ohm-cm, less than 15 Ohm-cm, less than 5 Ohm-cm, less than 2 Ohm-cm, less than 1 Ohm-cm, less than 0.5 Ohm-cm, or less than 0.1 Ohm-cm. The electrically conductive proppant pack containing the non-conductive proppant can have any suitable electrical conductivity. In one or more exemplary embodiments, the electrically conductive proppant pack containing at least about 20 wt %, at least about 40 wt %, at least about 50 wt %, or at least about 60 wt % non-conductive proppant can have an electrical conductivity of at least about 0.1 S/m, at least about 0.5 S/m, at least about 1 S/m, at least about 5 S/m, at least about 15 S/m, at least about 50 S/m, at least about 100 S/m, at least about 250 S/m, at least about 500 S/m, at least about 750 S/m, at least about 1,000 S/m, at least about 1,500 S/m, or at least about 2,000 S/m.

According to embodiments of the present invention, the electrically conductive proppant can be made from a conventional proppant such as a ceramic proppant, sand, plastic beads and glass beads. Such conventional proppants can be manufactured according to any suitable process including, but not limited to continuous spray atomization, spray fluidization, spray drying, or compression. Suitable conventional proppants and methods for their manufacture are disclosed in U.S. Pat. Nos. 4,068,718, 4,427,068, 4,440,866, 5,188,175, and 7,036,591, the entire disclosures of which are incorporated herein by reference.

Ceramic proppants vary in properties such as apparent specific gravity by virtue of the starting raw material and the manufacturing process. The term "apparent specific gravity" as used herein is the weight per unit volume (grams per cubic centimeter) of the particles, including the internal porosity. Low density proppants generally have an apparent specific gravity of less than 3.0 g/cm$^3$ and are typically made from kaolin clay and other alumina, oxide, or silicate ceramics. Intermediate density proppants generally have an apparent specific gravity of about 3.1 to 3.4 g/cm$^3$ and are typically made from bauxitic clay. High strength proppants are generally made from bauxitic clays with alumina and have an apparent specific gravity above 3.4 g/cm$^3$.

As described herein, sintered, substantially round and spherical particles, or proppants, are prepared from a slurry of alumina-containing raw material. In certain embodiments, the particles have an alumina content of from about 40% to about 55% by weight. In certain other embodiments, the sintered, substantially round and spherical particles have an alumina content of from about 41.5% to about 49% by weight.

In certain embodiments, the proppants have a bulk density of from about 1.35 g/cm$^3$ to about 1.55 g/cm$^3$. The term "bulk density", as used herein, refers to the weight per unit volume, including in the volume considered, the void spaces between the particles. In certain other embodiments, the proppants have a bulk density of from about 1.40 g/cm$^3$ to about 1.50 g/cm$^3$.

According to several exemplary embodiments, the proppants have any suitable permeability and fluid conductivity in accordance with ISO 13503-5: "Procedures for Measuring the Long-term Conductivity of Proppants," and expressed in terms of Darcy units, or Darcies (D). The proppants can have a long term permeability at 7,500 psi of at least about 1 D, at least about 2 D, at least about 5 D, at least about 10 D, at least about 20 D, at least about 40 D, at least about 80 D, at least about 120 D, or at least about 150 D. The proppants can have a long term permeability at 12,000 psi of at least about 1 D, at least about 2 D, at least about 3 D, at least about 4 D, at least about 5 D, at least about 10 D, at least about 25 D, or at least about 50 D. The proppants can have a long term conductivity at 7,500 psi of at least about 100 millidarcy-feet (mD-ft), at least about 200 mD-ft, at least about 300 mD-ft, at least about 500 mD-ft, at least about 1,000 mD-ft, at least about 1,500 mD-ft, at least about 2,000 mD-ft, or at least about 2,500 mD-ft. For example, the proppants can have a long term conductivity at 12,000 psi of at least about 50 mD-ft, at least about 100 mD-ft, at least about 200 mD-ft, at least about 300 mD-ft, at least about 500 mD-ft, at least about 1,000 mD-ft, or at least about 1,500 mD-ft.

In certain embodiments, the proppants have a crush strength at 10,000 psi of from about 5% to about 8.5%, and a long term fluid conductivity at 10,000 psi of from about 2500 mD-ft to about 3000 mD-ft. In certain other embodiments, the proppants have a crush strength at 10,000 psi of from about 5% to about 7.5%.

The proppants can have any suitable apparent specific gravity. In one or more exemplary embodiments, the proppants have an apparent specific gravity of less than 5, less than 4.5, less than 4.2, less than 4, less than 3.8, less than 3.5, or less than 3.2. In still other embodiments, the proppants have an apparent specific gravity of from about 2.50 to about 3.00, about 2.75 to about 3.25, about 2.8 to about 3.4, about 3.0 to about 3.5, or about 3.2 to about 3.8. In one or more exemplary embodiments, the proppants can have a specific gravity of about 5 or less, about 4.5 or less, about 4.2 or less, about 4 or less, or about 3.8 or less. The term "apparent specific gravity," (ASG) as used herein, refers to a number without units that is defined to be numerically equal to the weight in grams per cubic centimeter of volume, including void space or open porosity in determining the volume.

In one or more exemplary embodiments, the ceramic proppant can be manufactured in a manner that creates porosity in the proppant grain. A process to manufacture a suitable porous ceramic proppant is described in U.S. Pat. No. 7,036,591, the entire disclosure of which is incorporated herein by reference. In this case the electrically conductive material can be impregnated into the pores of the proppant grains to a concentration of about 0.01 wt %, about 0.05 wt %, about 0.1 wt %, about 0.5 wt %, about 1 wt %, about 2 wt %, or about 5 wt % to about 6 wt %, about 8 wt %, about 10 wt %, about 12 wt %, about 15 wt %, or about 20 wt % based on the weight of the electrically conductive proppant. Water soluble coatings such as polylactic acid can be used to coat these particles to allow for delayed/timed release of conductive particles.

The ceramic proppants can have any suitable porosity. The ceramic proppants can include an internal interconnected porosity from about 1%, about 2%, about 4%, about 6%, about 8%, about 10%, about 12%, or about 14% to about 18%, about 20%, about 22%, about 24%, about 26%, about 28%, about 30%, about 34%, about 38%, or about 45% or more. In several exemplary embodiments, the internal interconnected porosity of the ceramic proppants is from about 5 to about 35%, about 5 to about 15%, or about 15 to about 35%. According to several exemplary embodiments, the ceramic proppants have any suitable average pore size. For example, the ceramic proppant can have an average pore size from about 2 nm, about 10 nm, about 15 nm, about 55 nm, about 110 nm, about 520 nm, or about 1,100 nm to about 2,200 nm, about 5,500 nm, about 11,000 nm, about 17,000 nm, or about 25,000 nm or more in its largest dimension. For example, the ceramic proppant can have an average pore size from about 3 nm to about 30,000 nm, about 30 nm to about 18,000 nm, about 200 nm to about 9,000 nm, about 350 nm to about 4,500 nm, or about 850 nm to about 1,800 nm in its largest dimension.

Suitable sintered, substantially round and spherical particles can also include proppants manufactured according to vibration-induced dripping methods, herein called "drip casting." Suitable drip casting methods and proppants made therefrom are disclosed in U.S. Pat. Nos. 8,865,631, 8,883,693, and 9,175,210 and U.S. patent application Ser. Nos. 14/502,483 and 14/802,761, the entire disclosures of which are incorporated herein by reference. Proppants produced from the drip cast methods can have a specific gravity of at least about 2.5, at least about 2.7, at least about 3, at least about 3.3, or at least about 3.5. Proppants produced from the drip cast methods can have a specific gravity of about 5 or less, about 4.5 or less, or about 4 or less. The drip cast proppants can also have a surface roughness of less than 5 μm, less than 4 μm, less than 3 μm, less than 2.5 μm, less than 2 μm, less than 1.5 μm, or less than 1 μm. In one or more exemplary embodiments, the drip cast proppants have an average largest pore size of less than about 25 μm, less than about 20 μm, less than about 18 μm, less than about 16 μm, less than about 14 μm, or less than about 12 μm and/or a standard deviation in pore size of less than 6 μm, less than 4 μm, less than 3 μm, less than 2.5 μm, less than 2 μm, less than 1.5 μm, or less than 1 μm. In one or more exemplary embodiments, the drip cast proppants have less than 5,000, less than 4,500, less than 4,000, less than 3,500, less than 3,000, less than 2,500, or less than 2,200 visible pores at a magnification of 500× per square millimeter of proppant particle.

The proppants, produced by the drip casting methods or the conventional methods, can have any suitable composition. The proppants can be or include silica and/or alumina in any suitable amounts. According to one or more embodiments, the proppants include less than 80 wt %, less than 60 wt %, less than 40 wt %, less than 30 wt %, less than 20 wt %, less than 10 wt %, or less than 5 wt % silica based on the total weight of the proppants. According to one or more embodiments, the proppants include from about 0.1 wt % to about 70 wt % silica, from about 1 wt % to about 60 wt % silica, from about 2.5 wt % to about 50 wt % silica, from about 5 wt % to about 40 wt % silica, or from about 10 wt % to about 30 wt % silica. According to one or more embodiments, the proppants include at least about 30 wt %, at least about 50 wt %, at least about 60 wt %, at least about 70 wt %, at least about 80 wt %, at least about 90 wt %, or at least about 95 wt % alumina based on the total weight of the proppants. According to one or more embodiments, the proppants include from about 30 wt % to about 99.9 wt % alumina, from about 40 wt % to about 99 wt % alumina, from about 50 wt % to about 97 wt % alumina, from about 60 wt % to about 95 wt % alumina, or from about 70 wt % to about 90 wt % alumina. In one or more embodiments, the proppants produced by the processes disclosed herein can include alumina, bauxite, or kaolin, or any mixture thereof. For example, the proppants can be composed entirely of or composed essentially of alumina, bauxite, or kaolin, or any mixture thereof. The term "kaolin" is well known in the art and can include a raw material having an alumina content of at least about 40 wt % on a calcined basis and a silica content of at least about 40 wt % on a calcined basis. The term "bauxite" is well known in the art and can be or include a raw material having an alumina content of at least about 55 wt % on a calcined basis.

The proppants can also have any suitable size. According to one or more exemplary embodiments, the proppants can have a size of at least about 100 mesh, at least about 80 mesh, at least about 60 mesh, at least about 50 mesh, or at least about 40 mesh. For example, the proppants can have a size from about 115 mesh to about 2 mesh, about 100 mesh to about 3 mesh, about 80 mesh to about 5 mesh, about 80 mesh to about 10 mesh, about 60 mesh to about 12 mesh, about 50 mesh to about 14 mesh, about 40 mesh to about 16 mesh, or about 35 mesh to about 18 mesh. In a particular embodiment, the proppants have a size of from about 20 to about 40 U.S. Mesh.

According to certain embodiments described herein, the proppants are made in a continuous process, while in other embodiments, the proppants are made in a batch process.

An electrically conductive material such as a metal, a conductive polymer, or a conductive particle may be added at any suitable stage in the manufacturing process of any one of these proppants to result in an electrically conductive proppant suitable for use according to certain embodiments of the present invention. The electrically conductive material can also be added to any one of these proppants after manufacturing of the proppants. In one or more exemplary embodiments, the proppant can be a porous proppant, such that the electrically conductive material can be impregnated or infused into the pores of the proppant to provide the electrically conductive proppant. The porous proppant can be impregnated or infused with the electrically conductive material in any suitable amounts, such as from about 1% to 15% by weight. Water soluble coatings such as polylactic acid can be used to coat these particles to allow for delayed/timed release of conducting particles.

The electrically conductive material can be or include any suitable electrically conductive metal. For example, the metal can be or include iron, silver, gold, copper, aluminum, calcium, tungsten, zinc, nickel, lithium, platinum, palladium, rhodium, tin, carbon steel, or any combination or oxide thereof. In one or more exemplary embodiments, the electrically conductive material can be selected from one or more of aluminum, copper, nickel, and phosphorus and any alloy or mixture thereof. The electrically conductive proppant can have an electrically conductive metal concentration of about 0.01 wt %, about 0.05 wt %, about 0.1 wt %, about 0.5 wt %, about 1 wt %, about 2 wt %, or about 5 wt % to about 6 wt %, about 8 wt %, about 10 wt %, about 12 wt %, or about 14 wt %. In one or more exemplary embodiments, the metals can include aluminum, copper and nickel and can be added to result in a proppant having a metal content of from about 5% to about 10% by weight.

The electrically conductive material can be or include any suitable electrically conductive polymer. Suitable conductive polymers include poly(3,4-ethylenedioxythiophene) poly(styrenesulfonate) (PEDOT:PSS), polyanilines (PANI), and polypyrroles (PPY) and can be added to result in a proppant having any suitable conductive polymer content, such as from about 0.1% to about 10% by weight. In one or more exemplary embodiments, the electrically conductive proppant can have a conductive polymer concentration of about 0.01 wt %, about 0.05 wt %, about 0.1 wt %, about 0.5 wt %, about 1 wt %, about 2 wt %, or about 5 wt % to about 6 wt %, about 8 wt %, about 10 wt %, about 12 wt %, or about 14 wt %. Suitable PEDOT:PSS, PANI and PYY conductive polymers are commercially available from Sigma-Aldrich.

The electrically conductive material can be or include any suitable electrically conductive particle. Suitable conductive particles include graphite, single or double-walled carbon nanotubes, or other material that when present in the nanoscale particle size range exhibits sufficient electrical conductivity to allow for detection in the present invention. Suitable conductive particles can also include any suitable metal, such as iron, silver, gold, copper, aluminum, calcium, tungsten, zinc, nickel, lithium, platinum, tin, carbon steel, or any combination or oxide thereof. Such conductive particles can be added to result in an electrically conductive proppant having a conductive particle concentration of about 0.01 wt %, about 0.05 wt %, about 0.1 wt %, about 0.5 wt %, about 1 wt %, about 2 wt %, or about 5 wt % to about 6 wt %, about 8 wt %, about 10 wt %, about 12 wt %, or about 14 wt %. In one or more exemplary embodiments, the electrically conductive proppant can have a conductive nanoparticle content of from about 0.1% to about 10% by weight.

The conductive particles can have any suitable size. In one or more exemplary embodiments, the conductive particles have a size from about 1 nanometers (nm), about 5 nm, about 10 nm, about 50 nm, about 100 nm, about 500 nm, or about 1,000 to about 2,000 nm, about 5,000 nm, about 10,000 nm, about 15,000 nm, or about 20,000 nm in its largest dimension. For example, the conductive particles can be from about 2 nm to about 25,000 nm, about 25 nm to about 15,000 nm, about 50 nm to about 10,000 nm, about 150 nm to about 7,500, about 250 nm to about 4,000 nm, or about 750 nm to about 1,500 nm in its largest dimension. The conductive particles can also be from about 2 nm to about 2,000 nm, about 20 nm to about 500 nm, about 40 nm to about 300 nm, about 50 nm to about 250 nm, about 75 nm to about 200 nm, or about 100 nm to about 150 nm in its largest dimension.

In one or more exemplary embodiments of the present invention, the conductive particle is nano-sized or is a nanoparticle. In one or more exemplary embodiments, the conductive nanoparticle can have a size less than 500 nm, less than 250 nm, less than 150 nm, less than 100 nm, less than 95 nm, less than 90 nm, less than 85 nm, less than 80 nm, less than 75 nm, less than 70 nm, less than 65 nm, less than 60 nm, less than 55 nm, less than 50 nm, less than 45 nm, less than 40 nm, less than 35 nm, less than 30 nm, less than 25 nm, less than 20 nm, less than 15 nm, less than 10 nm, less than 5 nm, less than 2 nm, or less than 1 nm in its largest dimension.

In one or more exemplary embodiments, the electrically conductive material can be added at any stage in a method of manufacture of a conventional ceramic proppant. The method of manufacture of a conventional ceramic proppant can be or include a method similar in configuration and operation to that described in U.S. Pat. No. 4,440,866, the entire disclosure of which a incorporated herein by reference. In one or more exemplary embodiments, the electrically conductive material can be added at any stage in a method of manufacture of drip cast proppant. Suitable drip casting methods and proppants made therefrom are disclosed in U.S. Pat. Nos. 8,865,631 and 8,883,693, U.S. Patent Application Publication No. 2012/0227968, and U.S.

patent application Ser. No. 14/502,483, the entire disclosures of which are incorporated herein by reference.

According to certain embodiments of the present invention, the electrically conductive material is coated onto the proppants to provide the electrically conductive proppant. The coating may be accomplished by any coating technique well known to those of ordinary skill in the art such as spraying, sputtering, vacuum deposition, dip coating, extrusion, calendaring, powder coating, electroplating, transfer coating, air knife coating, roller coating and brush coating. In one or more exemplary embodiments, the electrically conductive material is coated onto the proppants with an electroless plating or coating method.

The electrically conductive material can also be incorporated into a resin material. Ceramic proppant or natural sands can be coated with the resin material containing the electrically conductive material such as metal clusters, metal flake, metal shot, metal powder, metalloids, metal nanoparticles, quantum dots, carbon nanotubes, buckminsterfullerenes, and other suitable electrically conductive materials to provide electrically conductive material-containing proppant that can be detected by electromagnetic means. Processes for resin coating proppants and natural sands are well known to those of ordinary skill in the art. For example, a suitable solvent coating process is described in U.S. Pat. No. 3,929,191, to Graham et al., the entire disclosure of which is incorporated herein by reference. Another suitable process such as that described in U.S. Pat. No. 3,492,147 to Young et al., the entire disclosure of which is incorporated herein by reference, involves the coating of a particulate substrate with a liquid, uncatalyzed resin composition characterized by its ability to extract a catalyst or curing agent from a non-aqueous solution. Also, a suitable hot melt coating procedure for utilizing phenol-formaldehyde novolac resins is described in U.S. Pat. No. 4,585,064, to Graham et al., the entire disclosure of which is incorporated herein by reference. Those of ordinary skill in the art will be familiar with still other suitable methods for resin coating proppants and natural sands.

According to certain embodiments of the present invention, the electrically conductive material is incorporated into a resin material and ceramic proppant or natural sands are coated with the resin material containing the electrically conductive material. Processes for resin coating proppants and natural sands are well known to those of ordinary skill in the art. For example, a suitable solvent coating process is described in U.S. Pat. No. 3,929,191, to Graham et al., the entire disclosure of which is incorporated herein by reference. Another suitable process such as that described in U.S. Pat. No. 3,492,147 to Young et al., the entire disclosure of which is incorporated herein by reference, involves the coating of a particle substrate with a liquid, uncatalyzed resin composition characterized by its ability to extract a catalyst or curing agent from a non-aqueous solution. Also a suitable hot melt coating procedure for utilizing phenol-formaldehyde novolac resins is described in U.S. Pat. No. 4,585,064, to Graham et al, the entire disclosure of which is incorporated herein by reference. Those of ordinary skill in the art will be familiar with still other suitable methods for resin coating proppants and natural sands.

According to several exemplary embodiments, the proppants disclosed herein are coated with a resin material to provide resin coated proppant particulates. According to several exemplary embodiments, the electrically conductive material can be mixed with the resin material and coated onto the proppants to provide the resin coated proppant particulates. According to several exemplary embodiments, at least a portion of the surface area of each of the resin coated proppant particulates is covered with the resin material. According to several exemplary embodiments, at least about 10%, at least about 25%, at least about 50%, at least about 75%, less than 90%, less than 95%, or less than 99% of the surface area of the resin coated proppant particulates is covered with the resin material. According to several exemplary embodiments, about 40% to about 90%, about 25% to about 80%, or about 10% to about 50% of the surface area of the resin coated proppant particulates is covered with the resin material. According to several exemplary embodiments, the entire surface area of the resin coated proppant particulates is covered with the resin material. For example, the resin coated proppant particulates can be encapsulated with the resin material.

According to several exemplary embodiments, the resin material is present on the resin coated proppant particulates in any suitable amount. According to several exemplary embodiments, the resin coated proppant particulates contain at least about 0.1 wt % resin, at least about 0.5 wt % resin, at least about 1 wt % resin, at least about 2 wt % resin, at least about 4 wt % resin, at least about 6 wt % resin, at least about 10 wt % resin, or at least about 20 wt % resin, based on the total weight of the resin coated proppant particulates. According to several exemplary embodiments, the resin coated proppant particulates contain about 0.01 wt %, about 0.2 wt %, about 0.8 wt %, about 1.5 wt %, about 2.5 wt %, about 3.5 wt %, or about 5 wt % to about 8 wt %, about 15 wt %, about 30 wt %, about 50 wt %, or about 80 wt % resin, based on the total weight of the resin coated proppant particulates.

According to several exemplary embodiments, the resin material includes any suitable resin. For example, the resin material can include a phenolic resin, such as a phenol-formaldehyde resin. According to several exemplary embodiments, the phenol-formaldehyde resin has a molar ratio of formaldehyde to phenol (F:P) from a low of about 0.6:1, about 0.9:1, or about 1.2:1 to a high of about 1.9:1, about 2.1:1, about 2.3:1, or about 2.8:1. For example, the phenol-formaldehyde resin can have a molar ratio of formaldehyde to phenol of about 0.7:1 to about 2.7:1, about 0.8:1 to about 2.5:1, about 1:1 to about 2.4:1, about 1.1:1 to about 2.6:1, or about 1.3:1 to about 2:1. The phenol-formaldehyde resin can also have a molar ratio of formaldehyde to phenol of about 0.8:1 to about 0.9:1, about 0.9:1 to about 1:1, about 1:1 to about 1.1:1, about 1.1:1 to about 1.2:1, about 1.2:1 to about 1.3:1, or about 1.3:1 to about 1.4:1.

According to several exemplary embodiments, the phenol-formaldehyde resin has a molar ratio of less than 1:1, less than 0.9:1, less than 0.8:1, less than 0.7:1, less than 0.6:1, or less than 0.5:1. For example, the phenol-formaldehyde resin can be or include a phenolic novolac resin. Phenolic novolac resins are well known to those of ordinary skill in the art, for instance see U.S. Pat. No. 2,675,335 to Rankin, U.S. Pat. No. 4,179,429 to Hanauye, U.S. Pat. No. 5,218,038 to Johnson, and U.S. Pat. No. 8,399,597 to Pullichola, the entire disclosures of which are incorporated herein by reference. Suitable examples of commercially available novolac resins include novolac resins available from Plenco™, Durite® resins available from Momentive, and novolac resins available from S.I. Group.

In one or more exemplary embodiments, the conducting particles disclosed herein can be infused into a porosity of the proppant particles. For example, one or more conducting particles can be infused into the porous structure of a proppant particle that is then coated with a coating that allows the conducting particles to elute from the pores of the proppant particle and rest at or near the outer surface of the proppant particle. The conducting particles can also be infused into and elute from the proppant particles in any suitable manner disclosed in U.S. patent application Ser. No. 14/629,004, which is incorporated herein by reference in its entirety.

The conducting particles can be introduced into the one or more subterranean fractures in any suitable manner. For example, the conducting particles can be mixed with a slurry of non-electrically conductive proppant to provide a conducting particle/non-electrically conductive proppant mixture at or near the surface. The conducting particle/non-electrically conductive proppant mixture can then be introduced into one or more subterranean fractures during any suitable hydraulic fracturing operation to provide an electrically conductive proppant pack when the conducting particles come to rest at or near the outer surfaces of the proppant in the proppant pack, making the proppant pack electrically conductive. In one or more exemplary hydraulic fracturing operations, any combination of the conductive particles and non-electrically conductive proppant can be introduced into one or more fractures to provide an electrically conductive proppant pack.

In one or more exemplary embodiments, the conductive particles are treated and/or coated with one or more chemicals or ligands to impart surface functionality to the conductive particles. These coatings can be selected from organic compound containing materials and/or organic compounds of varying chain lengths, each having functional groups on the terminus of their respective chains to modify or tailor the solubility (solubility, as used herein, also refers to a suspension or slurry) of the conductive particles in a produced fluid. These coatings can also be selected from organic compound containing materials and/or organic compounds of varying chain lengths, each having functional groups on the terminus of their respective chains to modify a surface functionality of the conductive particles so that they have an affinity for an outer surface of the proppant material in a proppant pack. These coatings can also be selected from organic compound containing materials and/or organic compounds of varying chain lengths, each having functional groups on the terminus of their respective chains to modify a surface functionality of the conductive particles so that they have an affinity for a resin coating of the resin coated proppant. Many commercially available surfactants can be used for these purposes. Ligands that are multi-functional can also be used as a coating, with one end of the ligand molecule binding to the conductive particle and the other end of the ligand molecule affecting the dispersibility of the conductive particle throughout a proppant pack. These multi-functional ligands can be modified by traditional organic synthetic methods and principles to increase or decrease the affinity of the conductive particles to the outer surfaces of the proppants in the proppant pack. Examples of the types of functional groups that can be used are carboxylates, amines, thiols, polysiloxanes, silanes, alcohols, and other species capable of binding to the conductive particle or the proppant surface. At least a portion of the conductive particles can remain at or near the proppant surface(s) of the proppant pack because the conductive particles have a greater affinity for the resin coat on the proppant particulates and/or outer surfaces of the proppant particulates than for fracturing fluid(s) and/or produced fluid(s).

Figure 7A:
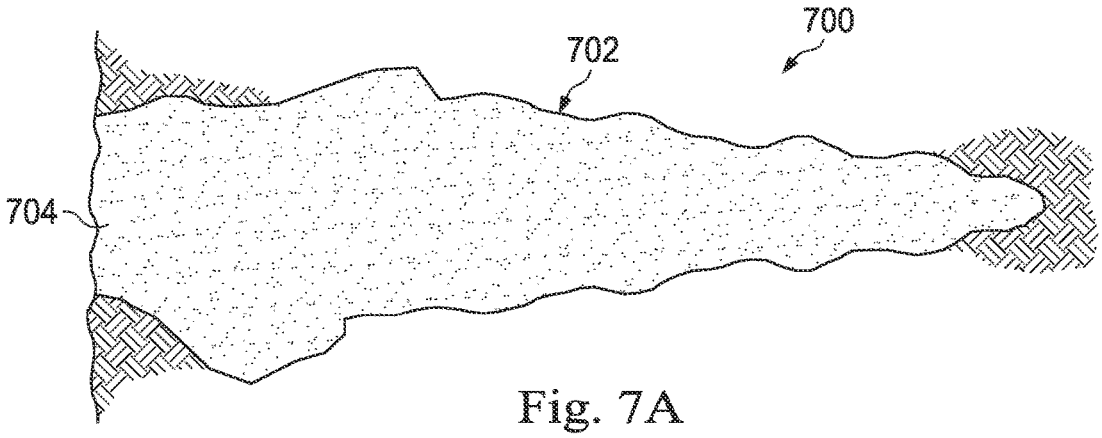
FIG. 7A is a schematic cross-sectional illustration off a proppant filled hydraulic fracture before closure.
Figure 7B:
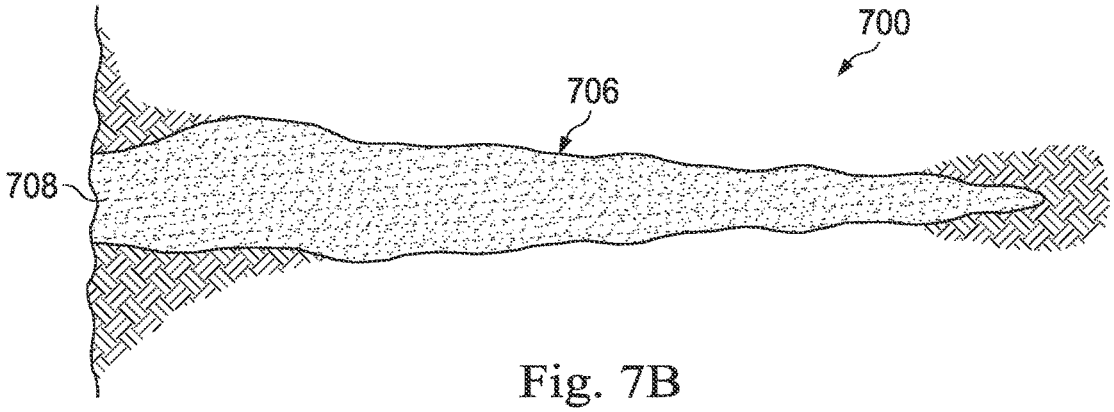
FIG. 7B is a schematic cross-sectional illustration off a proppant filled hydraulic fracture after closure.

FIG. 7A depicts an induced fracture 700 in an open state 702, or pre-closed state, containing an electrically conductive proppant pack under a first load 704. In one or more exemplary embodiments, the induced fracture 700 can extend approximately perpendicularly outward from a well casing that is in electrical communication with an electric current source located in the well casing, on the surface at or near the well casing, and/or in an adjacent wellbore. In one or more exemplary embodiments, the electrically conductive proppant pack is in electrical communication with a plurality of electric and/or magnetic field sensors located at or near the surface and/or in one or more adjacent wellbores. In one or more exemplary embodiments, the fracture 700 can be or include the proppant filled fracture 32. For example, the proppant filled fracture 32 can be in the open state 702 and can include the electrically conductive proppant pack under the first load 704. As used herein, the term "open state" refers to the condition of the fracture and the proppant pack contained therein prior to leak-off of fracturing fluid that occurs when the injection pressure of the fracturing fluid is released. After sufficient leak-off, the fracture will close, causing the fracture to transition from the open state 702 to the closed state. FIG. 7B depicts the fracture 700 in a closed state 706 containing the electrically conductive proppant pack of FIG. 7A under a second load 708. As used herein, the term "closed state" refers to the condition of the fracture and the proppant pack contained therein after leak-off of the fracturing fluid due to the injection pressure of the fracturing fluid being released.

At least a portion of the electric current generated by the source can travel from the well casing, such as well casing 22, and through the proppant in the fracture 700. Electromagnetic fields generated by the current in the well casing and that propagate to various locations in a volume of Earth can be altered by the presence of the electrically conductive proppant pack following the injection of the electrically conductive proppant into the fracture 700. Electromagnetic fields generated by the currents in both the well casing and the proppant pack propagate to various locations in a three-dimensional volume of Earth and are sensed, using the sensors 38 for example.

It has been found that an increased closure pressure or load onto the electrically conductive proppant pack due to the closing fracture can result in an increase in the electrical conductivity of the electrically conductive proppant pack. In one or more exemplary embodiments, increasing a load onto the pack of the electrically conductive proppant pack by a factor of 2, a factor of 5, or a factor of 10 can increase the electrical conductivity of the pack of the electrically conductive proppant by at least about 50%, at least about 75%, at least about 100%, at least about 150%, or at least about 200%. In one or more exemplary embodiments, increasing a load onto the pack of the electrically conductive proppant pack by a factor of 2, a factor of 5, or a factor of 10 can decrease the resistivity of the pack of the electrically conductive proppant pack 200 by from about 1%, about 2%, or about 5% to about 10%, about 15%, or about 25%.

It has also been found that the increase or change of the electrical conductivity and/or resistivity of the electrically conductive proppant pack can be detected to determine fracture closure and/or fracture closure time. In one or more exemplary embodiments, a change in the electrical conductivity and/or resistivity of the electrically conductive proppant pack along one or more time intervals can be detected and chronicled to determine fracture closure and fracture closure time. The fracture closure time can be determined when there are no further changes observed in the electrical conductivity and/or resistivity of the electrically conductive proppant pack. For example, no change detected in the electrical conductivity and/or resistivity of the electrically conductive proppant pack over two or more, three or more, four or more, five or more, or ten or more consecutive time intervals can indicate fracture closure.

The detection of closure and determination of closure time of a fracture will depend upon several factors, including but not limited to the net electrical conductivity of the fracture, fracture volume, the electrical conductivity, magnetic permeability, and electric permittivity of the earth surrounding the fracture and between the fracture and surface mounted sensors. The net electrical conductivity of the fracture means the combination of the electrical conductivity of the fracture, the proppant and the fluids when all are placed in the earth minus the electrical conductivity of the earth formation when the fracture, proppant and fluids were not present. Also, the total electrical conductivity of the proppant filled fracture is the combination of the electrical conductivity created by making a fracture, plus the electrical conductivity of the new/modified proppant plus the electrical conductivity of the fluids, plus the electro-kinetic effects of moving fluids through a porous body such as a proppant pack. The volume of an overly simplified fracture with the geometric form of a plane may be determined by multiplying the height, length, and width (i.e. gap) of the fracture. A three dimensional (3D) finite-difference electromagnetic algorithm that solves Maxwell's equations of electromagnetism may be used for numerical simulations. In order for the electromagnetic response of a proppant filled fracture at depth to be detectable at the Earth's surface, the net fracture conductivity multiplied by the fracture volume within one computational cell of the finite difference (FD) grid must be larger than approximately 100 $Sm^2$ for a Barnett shale-like model where the total fracture volume is approximately 38 $m^3$. For the Barnett shale model, the depth of the fracture is 2000 m. These requirements for the numerical simulations can be translated to properties in a field application for formations other than the Barnett shale.

The propagation and/or diffusion of electromagnetic (EM) wavefields through three-dimensional (3D) geological media are governed by Maxwell's equations of electromagnetism.

According to one embodiment of the present invention, the measured three dimensional components of the electric and magnetic field responses may be analyzed with imaging methods such as an inversion algorithm based on Maxwell's equations and electromagnetic migration and/or holography to determine proppant pack location and the closure time of the fracture surrounding the proppant pack. Inversion of acquired data to determine proppant pack location and the closure time of the fracture containing the proppant pack involves adjusting the earth model parameters, including but not limited to the proppant location within a fracture or fractures and the net electrical conductivity of the fracture, to obtain the best fit to forward model calculations of responses for an assumed earth model. As described in Bartel, L. C., Integral wave-migration method applied to electromagnetic data, SEG Technical Program Expanded Abstracts, 1994, 361-364, the electromagnetic integral wave migration method utilizes Gauss's theorem where the data obtained over an aperture are projected into the subsurface to form an image of the proppant pack. Also, as described in Bartel, L. C., Application of EM Holographic Methods to Borehole Vertical Electric Source Data to Map a Fuel Oil Spill, SEG Technical Program Expanded Abstracts, 1987, 49-51, the electromagnetic holographic method is based on the seismic holographic method and relies on constructive and destructive interferences where the data and the source wave form are projected into an earth volume to form an image of the proppant pack. Due to the long wave lengths of the low frequency electromagnetic responses for the migration and holographic methods, it may be necessary to transform the data into another domain where the wave lengths are shorter. As described in Lee, K. H., et al., A new approach to modeling the electromagnetic response of conductive media, Geophysics, Vol. 54, No. 9 (1989), this domain is referred to as the q-domain. Further, as described in Lee, K. H., et al., Tomographic Imaging of Electrical Conductivity Using Low-Frequency Electromagnetic Fields, Lawrence Berkeley Lab, 1992, the wave length changes when the transformation is applied.

Also, combining Maxwell's equations of electromagnetism with constitutive relations appropriate for time-independent isotropic media yields a system of six coupled first-order partial differential equations referred to as the "EH" system. The name derives from the dependent variables contained therein, namely the electric vector E and the magnetic vector H. Coefficients in the EH system are the three material properties, namely electrical current conductivity, magnetic permeability, and electric permittivity. All of these parameters may vary with 3D spatial position. The inhomogeneous terms in the EH system represent various body sources of electromagnetic waves, and include conduction current sources, magnetic induction sources, and displacement current sources. Conduction current sources, representing current flow in wires, cables, and borehole casings, are the most commonly-used sources in field electromagnetic data acquisition experiments.

In one or more exemplary embodiments, an explicit, time-domain, finite-difference (TDFD) numerical method is used to solve the EH system for the three components of the electric vector E and the three components of the magnetic vector H, as functions of position and time. A three-dimensional gridded representation of the electromagnetic medium parameters, referred to as the "earth model" is required, and may be constructed from available geophysical logs and geological information. A magnitude, direction, and waveform for the current source are also input to the algorithm. The waveform may have a pulse-like shape (as in a Gaussian pulse), or may be a repeating square wave containing both positive and negative polarity portions, but is not limited to these two particular options. Execution of the numerical algorithm generates electromagnetic responses in the form of time series recorded at receiver locations distributed on or within the gridded earth model. These responses represent the three components of the E or H vector, or their time-derivatives.

Repeated execution of the finite-difference numerical algorithm enables a quantitative estimate of the magnitude and frequency-content of electromagnetic responses (measured on the earth's surface or in nearby boreholes) to be made as important modeling parameters are varied. For example, the depth of current source may be changed from shallow to deep. The current source may be localized at a point, or may be a spatially-extended transmission line, as with an electrically charged borehole casing. The source waveform may be broad-band or narrow-band in spectral content. Finally, changes to the electromagnetic earth model can be made, perhaps to assess the shielding effect of shallow conductive layers. The goal of such a modeling campaign is to assess the sensitivity of recorded electromagnetic data to variations in pertinent parameters. In turn, this information is used to design optimal field data acquisition geometries that have enhanced potential for imaging a proppant-filled fracture at depth.

The electric and magnetic responses are scalable with the input current magnitude. In order to obtain responses above the background electromagnetic noise, a large current on the order of 10 to 100 amps may be required. The impedance of the electric cable to the current contact point and the earth contact resistance will determine the voltage that is required to obtain a desired current. The contact resistance is expected to be small and will not dominate the required voltage. In addition, it may be necessary to sum many repetitions of the measured data to obtain a measurable signal level over the noise level. In the field application and modeling scenarios, a time-domain current source waveform may be used, but not limited to a time-domain waveform. A typical time-domain waveform consists of an on time of positive current followed by an off time followed by an on time of negative current. In other words, + current, then off, then − current, then off again. The repetition rate to be used would be determined by how long the current has to be on until a steady-state is reached or alternatively how long the energizing current has to be off until the fields have died to nearly zero. In this exemplary method, the measured responses would be analyzed using the rise time fields following current turn-on, the steady-state values, and the decaying fields following the current shut-off. The advantage of analyzing the data when the energizing current is zero (decaying fields) is that the primary field contribution (response from the transmitting conductor; i.e., the well casing) has been eliminated and only the earth responses are measured. In addition, the off period of the time domain input signal allows analysis of the direct current electrical fields that may arise from electro-kinetic effects, including but not limited to, flowing fluids and proppant during the fracturing process. Fracture properties (orientation, length, volume, height and asymmetry will be determined through inversion of the measured data and/or a form of holographic reconstruction of that portion of the earth (fracture) that yielded the measured electrical responses or secondary fields. According to certain embodiments, a pre-fracture survey will be prepared to isolate the secondary fields due to the fracture. Those of ordinary skill in the art will recognize that other techniques for analyzing the recorded electromagnetic data, such as use of a pulse-like current source waveform and full waveform inversion of observed electromagnetic data may also be used.

In one or more exemplary embodiments, a frequency domain finite-difference (FDFD) numerical method is used to solve the EH system for the three components of the electric vector E and the three components of the magnetic vector H. The earth model, magnitude, direction, and waveform for the current source can be inputted to the algorithm. Similar to that of the TDFD numerical method, the waveform may have a pulse-like shape (as in a Gaussian pulse), or may be a repeating square wave containing both positive and negative polarity portions, but is not limited to these two particular options. Execution of the numerical algorithm generates electromagnetic responses in the form of frequency series recorded at receiver locations distributed on or within the gridded earth model. These responses represent the three components of the E or H vector, or their frequency-dependencies.

In one or more exemplary embodiments, an induced polarization (IP) effect is used to determine a location of the proppant and a closure time of the fracture containing the proppant. The IP effect is present in the time domain where the effect is measured following the cessation of the driving electric field. The IP effect is also present in the frequency domain wherein the effect is explained in terms of complex impedance. For time domain measurements the received voltage decay as a function of time is made when the input current is off. The frequency domain measures the phase delay from the input current and the effects of frequency on the received voltage.

The IP effect arises from various causes and different dependencies on the frequency of an impressed electric field. Central to some of the theories is fluid flow in porous media. In a porous medium the earth material is generally slightly negatively charged, thereby attracting positive charged ions in the fluid that makes up the electric double layer (EDL). This leaves the fluid in the pore space somewhat rich in negative charges that now conduct current in a porous medium. The ionic current is the difference in the concentrations of positive and negative ions. The flow of ions takes place due to an impressed electric field, pressure gradient, and/or diffusion where the pore space available for transport is restricted by the EDL. In addition, there are other restrictions for flow (pore throats, other material in the pore space) that can cause charge build up. A metallic ore, which is an electronic conductor, also affects the flow of the ions. Once the forcing electric field is switched off, the charge distribution "wants" to seek a lower energy state, which is the equilibrium condition. Diffusion of charges plays a major role in the quest to obtain equilibrium. In other words, when a surface is immersed or created in an aqueous solution, a discontinuity is formed at the interface where such physicochemical variables as electric potential and electrolyte concentration change significantly from the aqueous phase to another phase. Because of the different chemical potentials between the two phases, charge separation often occurs at the interfacial region. This interfacial region, together with the charged surface, is usually known as the EDL. This EDL, or layer, which can extend as far as 100 nm in a very dilute solution to only a few angstroms in a concentrated solution, plays an important role in electrochemistry, colloid science, and surface chemistry.

Once the conductive proppant has been placed into the fracture(s) and an electric current is supplied to the well casing, the component of the electric field perpendicular to the direction of the fracture will generally be larger than the component parallel to the fracture. The component of the electric field parallel to the fracture will induce ionic conductivity in the fracture fluid that will be impeded due to the ion mobility in the presence of the EDL and the charges induced on the conductive proppant. In addition, there will be electronic current flow via electrically conductive proppant that are in contact with each other. The current flow perpendicular to the fracture will not depend appreciably on the ionic flow but more on electronic conduction via the metallic coated proppant particles. The electronic conduction of electrical current will depend on the volume of the metal present and will rely on proppant particles to be in contact with each other.

If the energizing current is on for a sufficient amount of time so that the movement of charges has reached a steady state in the presence of the applied electric field, then when the current is terminated and the applied electric field goes to zero the charges must redistribute themselves to come to an equilibrium charge distribution. This redistribution does not occur instantaneously, but involves several decay mechanisms. Membrane IP effects can occur along with the electrode polarization effect. The conductive coatings present at or on the proppant surface can produce a significant IP response through the chargeability that is related to the surface impedance term. The surface impedance term will have some time (or frequency) dependent decay characteristic. This IP response from the conductive proppant particles will depend upon the total surface coated area of these proppant particles. For example, for a 1 micron thick metallic coating on a proppant particle substrate having a diameter 700 microns, the volume of metallic coating is approximately $15\times10^{-13}$ $m^3$ and the surface are per proppant particle is $1.54\times10^{-6}$ $m^2$. A 75% packing factor, for example, would mean $4.14\times10^9$ proppant particles per unit volume, where the total volume of metal is 0.0062 $m^3$ per cubic meter while the total surface area is 6380 $m^2$ per cubic meter. This calculation shows that the IP effect due to the metallic coated proppant particles has the potential to be greater than the enhanced conductivity effect of the metallic coated proppant particles.

Another EM response that impacts IP measurements is the inductive response of the earth. The inductive response arises from the Faraday/Lentz law which produces eddy currents in conductive media. The response is based upon the time-rate-of-change of the magnetic field; if the magnetic field is increasing, eddy currents are generated in the conductor (earth) to create a magnetic field opposite to the increasing magnetic field, and if the magnetic field is decreasing eddy currents are generated in the conductor to create a magnetic field opposite that of the decreasing magnetic field. The result of this is to produce a response much like the IP response; i.e., after a turn on of a primary magnetic field (turning on the current), the response takes time to achieve saturation and following the turn off of the primary magnetic field (turning off the current) the response slowly decays to zero. Along with the surrounding conducting earth, the conducting fracture (fluid and proppant) will generate an inductive response in addition to the IP response discussed above. Due to the coupling of electric and magnetic field through Maxwell's equations, the magnetic induction manifests itself in the electric field as well. The inductive and IP effects are additive. These two responses can be separated in the magnetic field due to their different frequency responses.

Also, the finite-difference solutions to Maxwell's equations, FDEM, includes the inductive responses, but not the IP responses. In one or more exemplary embodiments, the IP effects can be included into the FDEM algorithm by treating the IP effect as a time dependent source term. If the IP effect is treated as a time dependent source term, then the IP effect can be much larger than the pure conductive response.

In one or more exemplary embodiments, the closure of a subterranean fracture containing electrically conductive proppant can be determined by introducing a plurality or series of discrete electric currents ($a_1 \ldots a_N$) into the fracture. N can be any integer greater than 1. For example, N can be 2, 3, 4, 5, 6, 7, 8, or 9 or more. The series of electric currents ($a_1 \ldots a_N$) can correspond to a series of EM field measurements ($b_1 \ldots b_N$) so that $b_1$ is a measurement of the electric current $a_1$, $b_2$ is a measurement of the electric current $a_2$ and so on. The amount and/or extent of fracture closure can be determined by iteratively comparing measurements $b_N$ to $b_{N+1}$ to check for differences between two successive measurements. No difference or no substantial difference between successive measurements $b_N$ and $b_{N+1}$ can indicate closure of the fracture.

In one or more exemplary embodiments, the closure time of a fracture can be determined by introducing a series of discrete electric currents ($a_1 \ldots a_N$) into the fracture and obtaining the corresponding EM field measurements ($b_1 \ldots b_N$) over a period of time. The period of time can be or include any selected period of time between injecting an electrically conductive proppant containing slurry into the fracture and when closure of the fracture is indicated by no difference or no substantial difference between successive measurements $b_N$ and $b_{N+1}$. The period of time from injection of an electrically conductive proppant containing slurry into the fracture to the time in which no difference or no substantial difference between measurements $b_N$ and $b_{N+1}$ is indicated can be the closure time of the fracture.

A field data acquisition experiment was conducted to test the transmission line representation of a well casing current source. The calculated electric field and the measured electric field are in good agreement. This test demonstrates that the transmission line current source implementation in the 3D finite-difference electromagnetic code gives accurate results. The agreement, of course, depends upon an accurate model describing the electromagnetic properties of the earth. In this field data acquisition experiment, common electrical logs were used to characterize the electrical properties of the earth surrounding the test well bore and to construct the earth model.

The following examples are included to demonstrate illustrative embodiments of the present invention. It will be appreciated by those of ordinary skill in the art that the techniques disclosed in these examples are merely illustrative and are not limiting. Indeed, those of ordinary skill in the art should, in light of the present disclosure, appreciate that many changes can be made in the specific embodiments that are disclosed, and still obtain a like or similar result without departing from the spirit and scope of the invention.

Example 1

Conventional low density and medium density ceramic proppants which are commercially available from CARBO Ceramics Inc. of Houston, Tex. under the trade names CARBOLITE® (CL) 20/40, CARBOHYDROPROP® (HP or HYDROPROP) 40/80, CARBOPROP® 20/40 and CARBOPROP 40/70 were coated with thin layers of metals using RF magnetron sputtering. Three metal targets were used for the depositions, namely aluminum, copper and nickel. The depositions were performed in a sputter chamber using a 200 W RF power, a deposition pressure of 5 mTorr, and an argon background flow rate of 90 sccm. The sputter chamber had three articulating 2 inch target holders that can be used to coat complex shapes. The system also had a rotating, water-cooled sample stage that was used in a sputter-down configuration. Prior to coating the proppants, deposition rates for the three metals were determined by sputtering the metals onto silicon wafers and measuring the coating thickness by scanning electron microscope (SEM) cross-sectional analysis with a Zeiss Neon 40 SEM.

The proppants were loaded into the sputter chamber in a 12 inch diameter aluminum pan with 1 inch tall sides. Approximately 130 g of proppant was used for each coating run. This amount of proppant provided roughly a single layer of proppant on the base of the pan. The proppant was "stirred" during the deposition using a 6 inch long fine wire metal that was suspended above the pan and placed into contact with the proppant in the pan. The coating deposition times were doubled compared to what was determined from the silicon wafer coating thickness measurements to account for roughly coating the proppants on one side, rolling them over, and then coating the other side. Coatings of approximately 100 nm and approximately 500 nm were deposited on each type of proppant with each of the three metals.

Following the coating process, the proppant was inspected visually and by optical microscopy. The results indicated that the proppant having a thinner coating of approximately 100 nm had a generally non-uniform coating while the proppant with the thicker coating of approximately 500 nm had a uniform coating.

Figure 8:
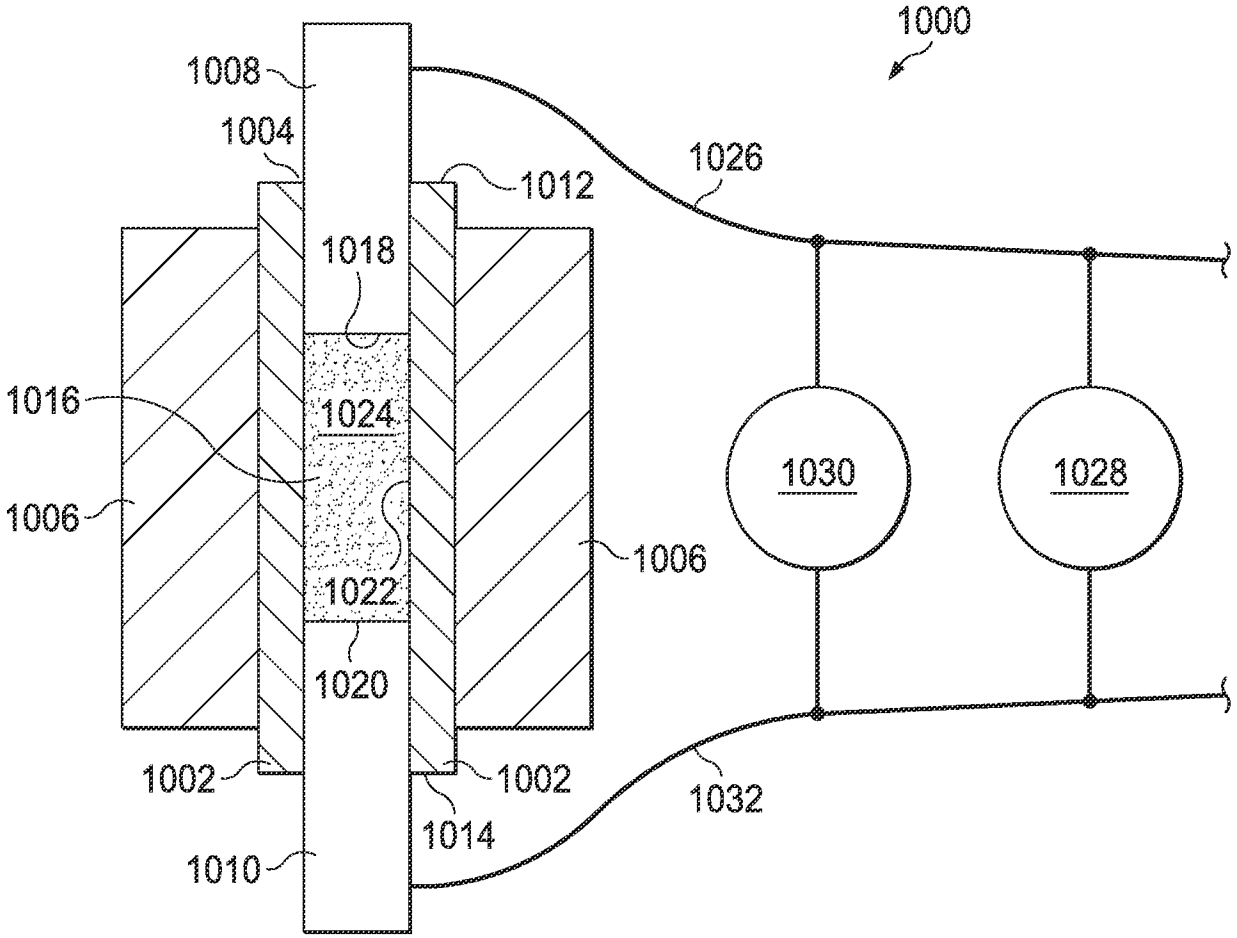
FIG. 8 is schematic illustration of a test system for measuring proppant electrical resistance.

Electrical measurements of mixtures of base proppants with varying percentages of such base proppants with coatings of aluminum in thicknesses of 500 nm prepared were conducted using the test device shown in FIG. 8. As shown in FIG. 8, the test system 1000 included an insulating boron nitride die 1002, having an inside diameter of 0.5 inches and an outside diameter of 1.0 inches, disposed in a bore 1004 in a steel die 1006 in which the bore 1004 had an inside diameter of 1.0 inches. Upper and lower steel plungers 1008 and 1010 having an outside diameter of 0.5 inches were inserted in the upper and lower ends 1012, 1014, respectively, of the insulating boron nitride die 1002 such that a chamber 1016 is formed between the leading end 1018 of the upper plunger 208, the leading end 1020 of the lower plunger 1010 and the inner wall 1022 of the boron nitride sleeve 1002. Upper plunger 1008 was removed from the insulating boron nitride die 1002 and proppant was loaded into the chamber 1016 until the proppant bed 1024 reached a height of about 1 to 2 cm above the leading end 1020 of the lower plunger 1010. The upper plunger 1008 was then reinstalled in the insulating boron nitride die 1002 until the leading end 1018 of the upper plunger 1008 engaged the proppant 1024. A copper wire 1026 was connected to the upper plunger 1008 and one pole of each of a current source 1028 and a voltmeter 1030. A second copper wire was connected to the lower plunger 1010 and the other pole of each of the current source 1028 and the voltmeter 1030. The current source may be any suitable DC current source well known to those of ordinary skill in the art such as a Keithley 237 High Voltage Source Measurement Unit in the DC current source mode and the voltmeter may be any suitable voltmeter well known to those of ordinary skill in the art such as a Fluke 175 True RMS Multimeter which may be used in the DC mV mode for certain samples and in the ohmmeter mode for higher resistance samples.

The current source was powered on and the resistance of the test system 1000 with the proppant bed 1024 in the chamber 1016 was then determined. The resistance of the proppant 1024 was then measured with the Multimeter as a function of pressure using the upper plunger 1008 and lower plunger 1010 both as electrodes and to apply pressure to the proppant bed 1024. Specifically, R=V/I–the resistance of the system with the plungers touching is subtracted from the values measured with the proppant bed 1024 in the chamber 1016 and the resistivity, $\rho=R*A/t$ where A is the area occupied by the proppant bed 1024 and t is the thickness of the proppant bed 1024 between the upper plunger 1008 and the lower plunger 1010.

The results were as follows:

Electrical measurements of base proppants without the addition of any conductive material were conducted at 100 V DC on samples that were 50 volume % proppant in wax that were pressed into discs nominally 1 inch in diameter and approximately 2 mm thick. Using these values to calculate the resistivity and using the measured resistivity for pure wax, the values below were extrapolated by plotting log (resistivity) vs. volume fraction proppant and extrapolating to a volume fraction of one:

CarboProp 40/70: $2\times10^{12}$ Ohm-cm

CarboProp 20/40: $0.6\times10^{12}$ Ohm-cm

CarboHydroProp: $1.8\times10^{12}$ Ohm-cm

CarboEconoProp: $9\times10^{12}$ Ohm-cm

It should be noted that the resistivities of the samples measured above are very high and not suitable for detection in the present invention.

Example 2

The results from using the test device shown in FIG. 8 to take the electrical measurements are shown in Tables I and II below.

Table I shows data for mixtures of CARBOLITE 20/40 with a 500 nm coating of aluminum and CARBOLITE 20/40 with no added conductive material. For each sample shown in Table I, 3 g. of the sample material was placed in the 0.5 inch die to provide an area of 0.196 square inches. The applied current for each test was 5 mA and the tests were conducted at room temperature.

TABLE I

| Load (lbs) | Pressure (psi) | Voltage (mV) | Resistance (Ohm) | Resistivity (Ohm-cm) |
|---|---|---|---|---|
| 80% 500 nm Al-coated CARBOLITE with 20% CARBOLITE 20/40 | | | | |
| 100 | 509 | 6.1 | 1.22 | 1.107 |
| 200 | 1019 | 5.6 | 1.12 | 1.016 |
| 300 | 1528 | 5.0 | 1.00 | 0.907 |
| 400 | 2037 | 4.7 | 0.94 | 0.853 |
| 500 | 2546 | 4.5 | 0.90 | 0.817 |
| 60% 500 nm Al-coated CARBOLITE with 40% CARBOLITE 20/40 | | | | |
| 200 | 1019 | 20.0 | 4.00 | 3.630 |
| 300 | 1528 | 17.8 | 3.56 | 3.230 |
| 400 | 2037 | 17.0 | 3.40 | 3.085 |
| 500 | 2546 | 16.1 | 3.22 | 2.922 |
| 600 | 3056 | 15.8 | 3.16 | 2.867 |
| 40% 500 nm Al-coated CARBOLITE with 60% CARBOLITE 20/40 | | | | |
| 100 | 509 | 253 | 50.60 | 46.516 |
| 200 | 1019 | 223 | 44.60 | 41.000 |
| 300 | 1528 | 218 | 43.60 | 40.080 |
| 400 | 2037 | 226 | 45.20 | 41.552 |
| 500 | 2546 | 221 | 44.20 | 40.632 |

Table II shows data for mixtures of HYDROPROP 40/80 with a 500 nm coating of aluminum and HYDROPROP 40/80 with no added conductive material. For each sample shown in Table II, 3 g. of the sample material was placed in the 0.5 inch die to provide an area of 0.196 square inches. The applied current for each test was 5 mA and the tests were conducted at room temperature.

TABLE II

| Load (lbs) | Pressure (psi) | Voltage (mV) | Resistance (Ohm) | Resistivity (Ohm-cm) |
|---|---|---|---|---|
| 80% 500 nm Al-coated HYDROPROP 40/80 with 20% HYDROPROP 40/80 | | | | |
| 100 | 509 | 5.9 | 1.18 | 1.083 |
| 200 | 1019 | 5.3 | 1.06 | 0.973 |
| 300 | 1528 | 4.9 | 0.98 | 0.900 |
| 400 | 2037 | 4.6 | 0.92 | 0.845 |
| 500 | 2546 | 4.4 | 0.88 | 0.808 |
| 60% 500 nm Al-coated HYDROPROP 40/80 with 40% HYDROPROP 40/80 | | | | |
| 200 | 1019 | 17.5 | 3.50 | 3.167 |
| 300 | 1528 | 15.6 | 3.12 | 2.823 |
| 400 | 2037 | 14.5 | 2.90 | 2.624 |
| 500 | 2546 | 13.8 | 2.76 | 2.497 |
| 40% 500 nm Al-coated HYDROPROP 40/80 with 60% HYDROPROP 40/80 | | | | |
| 200 | 1019 | 550 | 110.00 | 99.532 |
| 300 | 1528 | 470 | 94.00 | 85.055 |
| 400 | 2037 | 406 | 81.20 | 73.473 |
| 500 | 2546 | 397 | 79.40 | 71.844 |

As can be seen from TABLES I and II, the resistivity of the proppant packs, regardless of the relative amounts of coated or un-coated proppant, tends to decrease with increasing closure pressure. In addition, as the relative amount of uncoated proppant increases and the relative amount of coated proppant decreases, the resistivity of the proppant packs increases dramatically. Lastly, the lowest resistivity is achieved with 100% Al-coated proppant. No mixture of coated and uncoated proppant results in a resistivity measurement less than 100% Al-coated proppant.

Example 3

Figure 9:
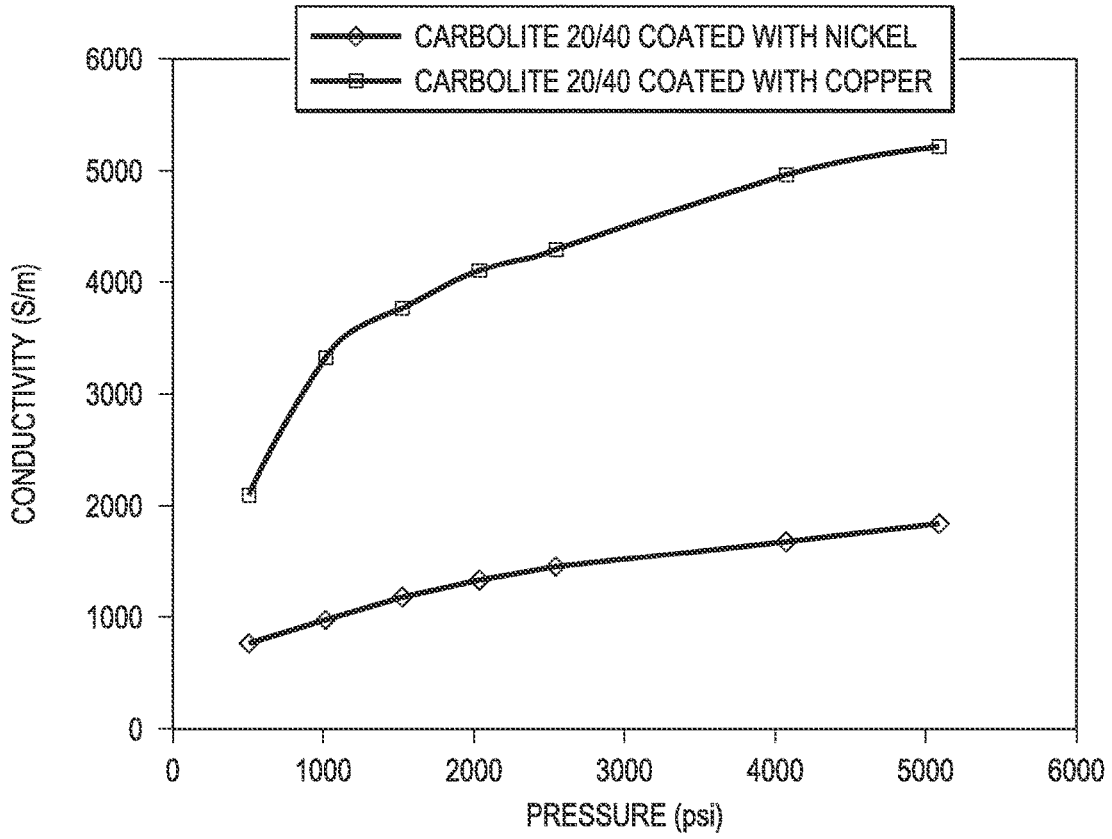
FIG. 9 is a graph of Conductivity (Siemens/m) vs. Pressure (psi) for CARBOLITE 20/40 coated with nickel and CARBOLITE 20/40 coated with copper.

Electrical measurements of proppants with coatings of nickel and copper were also conducted. The results are shown in TABLE III below and FIG. 9. TABLE III shows data for CARBOLITE 20/40 with a coating of nickel and CARBOLITE 20/40 with a coating of copper. For each sample shown in TABLE III, the sample material was placed in the 0.5 inch die. The applied voltage for each test was 0.005V.

TABLE III

| Load (lbs) | Pressure (psi) | Current (mA) | Resistance (Ohm) | Conductivity (S/m) |
|---|---|---|---|---|
| Ni-coated CARBOLITE 20/40 | | | | |
| 100 | 509 | 5.9 | 0.85 | 766.04 |
| 200 | 1019 | 6.1 | 0.75 | 966.44 |
| 300 | 1528 | 7.4 | 0.68 | 1182.18 |
| 400 | 2037 | 7.8 | 0.64 | 1327.66 |
| 500 | 2546 | 8.1 | 0.62 | 1449.91 |
| 800 | 4074 | 8.6 | 0.58 | 1684.37 |
| 1000 | 5093 | 8.9 | 0.56 | 1847.51 |
| Cu-coated CARBOLITE 20/40 | | | | |
| 100 | 509 | 9.3 | 0.54 | 2098.05 |
| 200 | 1019 | 10.6 | 0.47 | 3330.51 |
| 300 | 1528 | 10.9 | 0.46 | 3766.11 |
| 400 | 2037 | 11.1 | 0.45 | 4108.19 |
| 500 | 2546 | 8.1 | 0.45 | 4298.15 |
| 800 | 4074 | 11.2 | 0.43 | 4962.66 |
| 1000 | 5093 | 11.5 | 0.43 | 5222.51 |

Example 4

Figure 10:
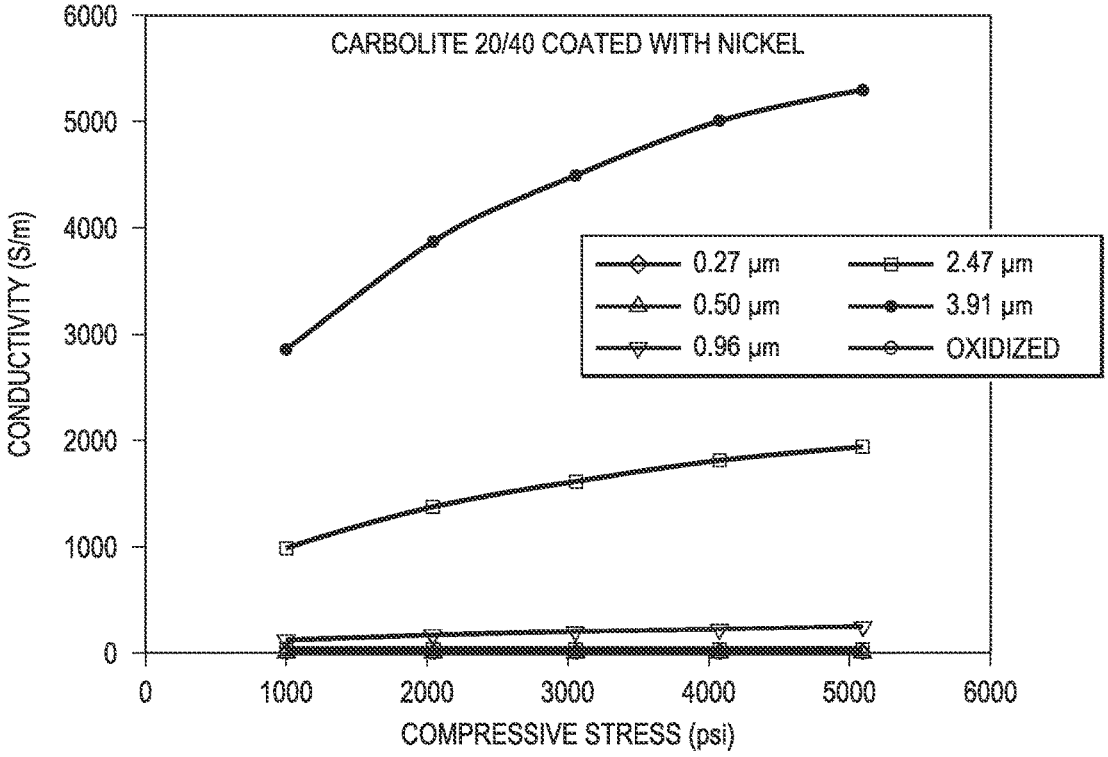
FIG. 10 is a graph of Conductivity (Siemens/m) vs. Pressure (psi) for CARBOLITE 20/40 coated with varied thickness of nickel.

Electrical measurements of proppants having coatings of varied thicknesses of nickel were also conducted. The results are shown in TABLE IV below and FIG. 10. TABLE IV shows data for CARBOLITE 20/40 with a coating of nickel at thicknesses of 0.27 microns, 0.50 microns, 0.96 microns, 2.47 microns, and 3.91 microns. One sample in FIG. 10 became oxidized and because of this was not sufficiently conductive for purposes of this example. For each sample shown in TABLE IV, the sample material was placed in the 0.5 inch die. The applied voltage for each test was 0.01V.

TABLE IV

| Load (lbs) | Pressure (psi) | Current (mA) | Resistance (Ohm) | Conductivity (S/m) |
|---|---|---|---|---|
| CARBOLITE 20/40 with 0.27 micron thick Ni-coating | | | | |
| 200 | 1019 | 1.0E−07 | 1.00E+08 | 3.738E−06 |
| 400 | 2037 | 0.004 | 2.56E+03 | 0.146 |
| 600 | 3056 | 0.021 | 4.76E+02 | 0.786 |
| 800 | 4074 | 0.040 | 2.50E+02 | 1.498 |
| 1000 | 5093 | 0.055 | 1.82E+02 | 2.060 |

TABLE IV-continued

| Load (lbs) | Pressure (psi) | Current (mA) | Resistance (Ohm) | Conductivity (S/m) |
|---|---|---|---|---|
| CARBOLITE 20/40 with 0.50 micron thick Ni-coating | | | | |
| 200 | 1019 | 0.06 | 1.82E+02 | 2.060 |
| 400 | 2037 | 0.23 | 4.35E+01 | 8.674 |
| 600 | 3056 | 0.39 | 2.56E+01 | 14.800 |
| 800 | 4074 | 0.52 | 1.92E+01 | 19.833 |
| 1000 | 5093 | 0.61 | 1.64E+01 | 23.347 |
| CARBOLITE 20/40 with 0.96 micron thick Ni-coating | | | | |
| 200 | 1019 | 2.8 | 3.57 | 117.198 |
| 400 | 2037 | 3.9 | 2.56 | 171.292 |
| 600 | 3056 | 4.5 | 2.22 | 203.110 |
| 800 | 4074 | 4.9 | 2.04 | 225.317 |
| 1000 | 5093 | 5.3 | 1.89 | 248.375 |
| CARBOLITE 20/40 with 2.47 micron thick Ni-coating | | | | |
| 200 | 1019 | 13.2 | 7.58E−01 | 994.508 |
| 400 | 2037 | 15.3 | 6.54E−01 | 1374.809 |
| 600 | 3056 | 16.3 | 6.13E−01 | 1612.612 |
| 800 | 4074 | 17.0 | 5.88E−01 | 1809.833 |
| 1000 | 5093 | 17.4 | 5.75E−01 | 1936.619 |
| CARBOLITE 20/40 with 3.91 micron thick Ni-coating | | | | |
| 200 | 1019 | 19.5 | 0.513 | 2850.607 |
| 400 | 2037 | 20.9 | 0.478 | 3862.317 |
| 600 | 3056 | 21.5 | 0.465 | 4480.414 |
| 800 | 4074 | 21.9 | 0.457 | 4988.307 |
| 1000 | 5093 | 22.1 | 0.452 | 5279.416 |

Example 5

This example is a prophetic example based on an expected change in measured field values for proppant conductivity increasing from 1,000 S/m to 5,000 S/m. In this example, a computer simulation utilized an observed earth model containing a horizontal well. The simulation included a current injection of 20 Amps and two electric field sensors separated by 80 meters (m). The simulation also included simulated fracture zones in which lab results of nickel coated proppant particulates were utilized.

Figure 11:
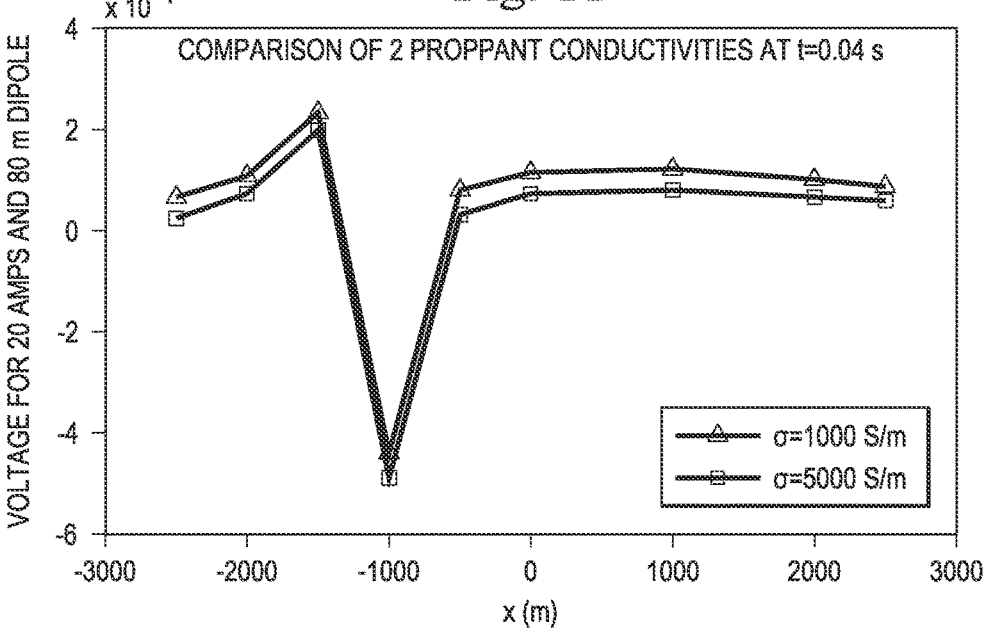
FIG. 11 shows a profile of a simulation of voltage measured between a pair of simulated electric field sensors along a line that is over the horizontal section of a well track.

FIG. 11 shows the profile of the calculated voltage determined between the pair of electric field sensors along a line that is over the horizontal section of a well track that extends from x=−2,500 m to 2,500 m. The distance x extends parallel to the horizontal section of the well track. The wellhead intersects this x distance at x=−1200 m for this particular model run and the target fractures are approximately at x=−1000 m. The spacing on the calculated results is 500 m. The peak of the inductive response was observed at 0.04 seconds after current injection.

FIG. 11 shows that the magnitude of the response for the more conductive proppant is less than for the lesser conductive proppant. The reason for his is two-fold: (1) due to the conductivity of the proppant, the magnitude of the electric field inside the proppant pack of 5,000 S/m is less than for the 1,000 S/m proppant pack and this difference manifests itself at the surface, and (2) the secondary electromagnetic induction fields for the 5,000 S/m material are larger than for the 1,000 S/m material and, due to Lentz's law, leads to a larger field in opposition to an increasing primary magnetic field in the conducting earth. These induction responses manifest themselves as a reduction of the measured response. The simulated data used in FIG. 11 is shown in Table V below.

TABLE V

| Expected Field Values | | |
|---|---|---|
| x | 1000 S/m | 5000 S/m |
| −2500 | 6.2139e−05 | 3.2325e−05 |
| −2000 | 0.00010109 | 6.6891e−05 |
| −1500 | 0.00023311 | 0.00019501 |
| −1000 | −0.00045051 | −0.00049103 |
| −500 | 7.7055e−05 | 3.5276e−05 |
| 0 | 0.00010875 | 6.7849e−05 |
| 500 | 0.00011653 | 7.8264e−05 |
| 1000 | 0.00011344 | 7.9026e−05 |
| 1500 | 0.00010499 | 7.4998e−05 |
| 2000 | 9.4293e−05 | 6.8751e−05 |
| 2500 | 8.3183e−05 | 6.1741e−05 |

When used as a proppant, the particles described herein may be handled in the same manner as ordinary proppants. For example, the particles may be delivered to the well site in bags or in bulk form along with the other materials used in fracturing treatment. Conventional equipment and techniques may be used to place the particles in the formation as a proppant. For example, the particles are mixed with a fracture fluid, which is then injected into a fracture in the formation.

In an exemplary method of fracturing a subterranean formation, a hydraulic fluid is injected into the formation at a rate and pressure sufficient to open a fracture therein, and a fluid containing sintered, substantially round and spherical particles prepared from a slurry as described herein and having one or more of the properties as described herein is injected into the fracture to prop the fracture in an open condition.

The foregoing description and embodiments are intended to illustrate the invention without limiting it thereby. It will be understood that various modifications can be made in the invention without departing from the spirit or scope thereof.

What is claimed is:

1. A method for determining fracture closure, comprising:

electrically energizing a casing of a wellbore that extends from a surface of the earth into a subterranean formation having a fracture that is at least partially filled with an electrically conductive proppant;

measuring a first electric field response at the surface or in an adjacent wellbore at a first time interval to provide a first field measurement;

measuring a second electric field response at the surface or in the adjacent wellbore at a second time interval to provide a second field measurement; and determining an increase in closure pressure on the electrically conductive proppant from a difference between the first and second field measurements.

2. The method of claim 1, wherein measuring the first electric field response comprises measuring three dimensional (x, y, and z) components of electric and magnetic field responses.

3. The method of claim 2, wherein measuring the second electric field response comprises measuring three dimensional (x, y, and z) components of electric and magnetic field responses.

4. The method of claim 3, further comprising:

measuring three dimensional (x, y, and z) components of electric and magnetic field responses at the surface or in the adjacent wellbore at three or more time intervals to provide three or more field measurements; and determining an increase in closure pressure on the electrically conductive proppant from differences between each of the three or more field measurements.

5. The method of claim 1, further comprising:

injecting into the fracture the electrically conductive proppant and wherein the electrically conductive proppant includes electrically conductive sintered, substantially round and spherical particles; and prior to the injecting of the electrically conductive proppant into the fracture, injecting a hydraulic fluid into the wellbore at a rate and pressure sufficient to open the fracture therein.

6. The method of claim 3, wherein the measuring of the three dimensional (x, y, and z) components of electric and magnetic field responses at the surface or in an adjacent wellbore comprises measuring the three dimensional (x, y, and z) components of electric and magnetic field responses using an array of sensors distributed at or near the surface and at least partially over the fracture.

7. The method of claim 1, wherein the increase in closure pressure on the electrically conductive proppant increases the electrical conductivity of the electrically conductive proppant by at least about 50%.

8. The method of claim 4, further comprising determining a closure of the fracture by observing substantially no difference between two successive field measurements.

9. The method of claim 1, wherein, numerical simulations, solving Maxwell's equations of electromagnetism for the electric and magnetic fields are performed, prior to obtaining the first field measurement, to determine temporal characteristics of an optimum input wave form and a recording sensor array geometry to be used in the field applications, wherein the numerical simulations are based upon an earth model determined from geophysical logs and geological information.

10. A method for determining fracture closure time, comprising:

introducing a first electric current to a subterranean formation extending from a wellbore;

obtaining a first measurement by measuring three dimensional (x, y, and z) components of electric and magnetic field responses from the first electric current at a surface of the earth or in an adjacent wellbore;

injecting a hydraulic fluid into the subterranean formation at a rate and pressure sufficient to open a fracture therein;

injecting into the fracture a fluid containing electrically conductive sintered, substantially round and spherical particles under a first pressure;

introducing a second electric current to the earth at or near the fracture containing the electrically conductive sintered, substantially round and spherical particles;

obtaining a second measurement by measuring three dimensional (x, y, and z) components of electric and magnetic field responses from the second electric current at a surface of the earth or in an adjacent wellbore;

releasing the first pressure;

introducing a third electric current to the earth at or near the fracture;

obtaining a third measurement by measuring three dimensional (x, y, and z) components of electric and magnetic field responses from the third electric current at a surface of the earth or in an adjacent wellbore; and determining a difference between the first and second measurements.

11. The method of claim 10, wherein the fracture is in an open state when the second measurement is obtained.

12. The method of claim 10, further comprising:

introducing a series of discrete electric current injections ($a_1 \ldots a_N$) to the earth at or near the fracture, wherein N is any integer greater than 3 and $a_1$ is the first electric current; and obtaining discrete measurements ($b_1 \ldots b_N$) for each of ($a_1 \ldots a_N$) by measuring three dimensional (x, y, and z) components of electric and magnetic field responses from each of the ($a_1 \ldots a_N$) electric current injections at a surface of the earth or in an adjacent wellbore, wherein $b_1$ is the first measurement.

13. The method of claim 12, further comprising iteratively comparing measurements $b_N$ and $b_{N+1}$ to check for differences between two successive measurements, wherein closure of the fracture is determined by observing no substantial difference between $b_N$ and $b_{N+1}$.

14. The method of claim 13, wherein $b_{N+1}$ is a final measurement when there is no observed substantial difference between $b_N$ and $b_{N+1}$ and a fracture closure time is determined by calculating time accrued from injecting into the fracture the fluid containing electrically conductive sintered, substantially round and spherical particles under a first pressure to introducing electric current $a_{N+1}$.

15. The method of claim 10, wherein the measured three dimensional components of the electric and magnetic field responses are analyzed with imaging methods selected from the group consisting of an inversion algorithm based on Maxwell's equations of electromagnetism and electromagnetic holography to determine a proppant pack location, wherein, in the inversion algorithm, parameters of an earth model are adjusted to obtain a fit to a plurality of forward model calculations of responses for an assumed earth model, and wherein, in the electromagnetic holography, the electric and magnetic field responses and a source wave form are projected into an earth volume to form an image of the proppant pack location using constructive and destructive interferences.

16. The method of claim 10, wherein electromagnetic wave forms selected from the group consisting of Gaussian, square and time domain are used as an input signal to generate the three dimensional electric field and magnetic field responses.

17. The method of claim 15, wherein, numerical simulations, solving Maxwell's equations of electromagnetism for the electric and magnetic fields are performed, prior to field applications, to determine temporal characteristics of an optimum input wave form and a recording sensor array geometry to be used in the field applications, wherein the numerical simulations are based upon an earth model determined from geophysical logs and geological information.

18. A method for determining fracture closure time, comprising:

introducing a first electric current to a subterranean formation extending from a wellbore;

obtaining a first measurement by measuring three dimensional (x, y, and z) components of electric and magnetic field responses from the first electric current at a surface of the earth or in an adjacent wellbore;

injecting a hydraulic fluid into the subterranean formation at a rate and pressure sufficient to open a fracture therein;

injecting into the fracture a fluid containing electrically conductive sintered, substantially round and spherical particles under a first pressure;

introducing a second electric current to the earth at or near the fracture containing the electrically conductive sintered, substantially round and spherical particles;

obtaining a second measurement by measuring three dimensional (x, y, and z) components of electric and magnetic field responses from the second electric current at a surface of the earth or in an adjacent wellbore;

releasing the first pressure;

introducing a series of discrete electric current injections ($a_1 \ldots a_N$) to the earth at or near the fracture, wherein N is any integer greater than 2 and $a_1$ is the first electric current; and obtaining discrete measurements ($b_1 \ldots b_N$) for each of ($a_1 \ldots a_N$) by measuring three dimensional (x, y, and z) components of electric and magnetic field responses from each of the ($a_1 \ldots a_N$) electric current injections at a surface of the earth or in an adjacent wellbore; and determining a difference between the first and second measurements.

19. The method of claim 18, further comprising iteratively comparing measurements $b_N$ and $b_{N+1}$ to check for differences between two successive measurements, wherein closure of the fracture is determined by observing no substantial difference between $b_N$ and $b_{N+1}$.

20. The method of claim 19, wherein $b_{N+1}$ is a final measurement when there is no observed substantial difference between $b_N$ and $b_{N+1}$ and a fracture closure time is determined by calculating time accrued from injecting into the fracture the fluid containing electrically conductive sintered, substantially round and spherical particles under a first pressure to introducing electric current $a_{N+1}$.

* * * * *